US006312400B1

(12) United States Patent
Itikawa et al.

(10) Patent No.: US 6,312,400 B1
(45) Date of Patent: Nov. 6, 2001

(54) AIR EXPANDABLE BODIES RECIPROCATING A MASSAGE ELEMENT

(75) Inventors: Hiromitu Itikawa, Odawara; Syouji Hosino, Atsugi; Yuuji Suzuki, Kanagawa, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/465,346

(22) Filed: Dec. 16, 1999

Related U.S. Application Data

(63) Continuation of application No. PCT/JP99/02253, filed on Apr. 27, 1999.

(30) Foreign Application Priority Data

Apr. 27, 1998 (JP) ..... 10-116670
May 22, 1998 (JP) ..... 10-141258
Aug. 13, 1998 (JP) ..... 10-228951

(51) Int. Cl.[7] ..... A61H 23/00; A61H 23/04

(52) U.S. Cl. ..... 601/100; 601/101; 601/103; 601/116; 601/105

(58) Field of Search ..... 601/97–103, 105, 601/115, 116, 126, 118, 122, 127, 136; 294/93 HP

(56) References Cited

U.S. PATENT DOCUMENTS 3,259,405 * 7/1966 Heller .
3,401,607 * 9/1968 Wortman .
5,741,218 * 4/1998 Fujii ..... 601/90
5,762,618 * 6/1998 Yamanaka et al. ..... 601/148
6,117,904 * 9/2000 Murphy et al. ..... 514/547

FOREIGN PATENT DOCUMENTS 7-80035 3/1995 (JP) .
9-10269 1/1997 (JP) .
9-122193 5/1997 (JP) .

* cited by examiner

*Primary Examiner*—Danton D. DeMille
(74) *Attorney, Agent, or Firm*—Frishauf, Holtz, Goodman, Langer & Chick, P.C.

(57) ABSTRACT

In a positioning device, expandable bodies which expand and contract by air pressure are disposed at opposite sides of a movable member in its moving direction, the movable member being able to reciprocate, and a valve device for holding the expandable bodies in their extended states by valve-closing action is provided in an air path device which supplies air from an air supplying device to the expandable bodies. In a massager including this positioning device, the movable member is movably guided in up and down directions by a guide member provided in a back rest of a chair body, and the movable member is provided with a massage element which is projected from a surface of the back rest and is abutted against a body of a person sitting on the chair body. The movable member is moved by supply and discharge of air to and from the air supplying device through the air path device to the expandable bodies provided at the opposite sides of the movable member in its moving direction, and the movement position of the movable member is adjusted by the valve devices of the air path device.

9 Claims, 15 Drawing Sheets

AIR EXPANDABLE BODIES RECIPROCATING A MASSAGE ELEMENT

CROSS REFERENCE TO RELATED APPLICATIONS

This is a continuation of Application No. PCT/JP99/02253, filed Apr. 27, 1999.

BACKGROUND OF THE INVENTION

The present invention relates to a positioning device and to a massager provided with this positioning device. The massager includes a massager body and a movable massage element mounted to the massager body and being able to reciprocate. In the massager, the positioning device is used for adjusting a reference height position of the movable massage element with respect to the massager body.

In some of conventional chair type massagers including neck massage elements, the neck massage element can adjust a reference height position in up and down directions along a back rest. This is because a height of a predetermined position of a neck at which a user sitting on a chair body (massager body) of the massager desires to be massaged is different from each other among a plurality of people. Therefore, in a massager having a movable massage element whose reference height position can be adjusted, whenever a different user sits on the chair body (massager body), the movable massage element are moved in the up and down directions to adjust the reference height position such that the movable massage element is disposed in the predetermined height at which the user sitting on the chair body (massager body) desires to be massaged.

In such a conventional chair type massager, the reference height position of the movable massage element is adjusted by moving a movable member which supports the movable massage element in the back rest in the up and down directions by a mechanical driving mechanism embedded in the back rest. The mechanical driving mechanism includes an electric motor, a reduction gear device for decelerating a rotation of an output shaft of the electric motor, and a driving force transmitting mechanism for transmitting the decelerated driving force from the reduction gear device to the movable member supporting the movable massage element.

However, in such a conventional mechanical driving mechanism, whenever the reference height position of the movable massage element is adjusted, operating noise of the electric motor, meshing noise of gears of the reduction gear device and operating noise of the driving force transmitting mechanism are generated and thus, great noise is generated. Further, the electric motor and the reduction gear device are heavy and expensive.

The present invention has been derived from the above circumstances, and an object of the present invention is to provide a positioning device and a massager provided with such a positioning device capable of suppressing noise generated during adjusting operation of a reference height position of a movable massage element, and capable of reducing a weight and a manufacturing cost.

BRIEF SUMMARY OF THE INVENTION

To achieve the above object, a positioning device according to the present invention comprises:

a movable member provided for reciprocating motion;

expandable bodies disposed at opposite sides of the movable member in its moving direction and expanded and contracted by air pressure;

an air supplying device;

an air path device for bringing the air supplying device and the expandable bodies into communication with each other, and for supplying air from the air supplying device to the expandable bodies; and a valve device provided in the air path device, for opening and closing the air path device, and for holding the expandable bodies in arbitrary expanded states by a valve closing action.

In the positioning device of the present invention characterized in such a structure as described above, movement of the movable member and stop thereof at a desired position are carried out by the expandable bodies which expand and contract by air pressure. Therefore, noise generated when the movable member is moved to the desired position is lowered. Further, an expensive electric motor and a reduction gear device used in the above-described conventional mechanical driving mechanism can be omitted, a manufacturing cost of the positioning device can be reduced.

In the positioning device of the present invention characterized in such a structure as described above, when the movable member is capable of reciprocating in up and down directions and the expandable bodies are disposed above and under the movable member, it is preferable that an upper end of the expandable body disposed under the movable member is connected to the movable member, and a lower end of the expandable body disposed above the movable member is capable of contacting with and separating from the movable member.

The lower end of the expandable body disposed in an upper side of the movable body can be so structured that it is capable of contacting with and separating from the movable member because the expandable body of the upper side needs not to transmit great force to the movable member only when the expandable body expands. with this structure, the manufacturing cost of the positioning device of the invention can further be reduced.

In the positioning device of the present invention characterized in such a structure as described above, it is preferable that each of the expandable bodies is formed into a bellows shape.

With such a structure, it is possible to accurately define expansion and contraction directions of the expandable body to set a size in other than the expansion and contraction directions to a small value, and to set a size in the expansion and contraction directions to a great value.

In the positioning device of the present invention characterized in such a structure as described above, it is preferable that the positioning device further comprises a supporting member extending in expanding and contracting directions of the expandable bodies and supporting ends of the expandable bodies opposite from the movable member.

With such a structure, a rigidity of the positioning device of the present invention is enhanced, directions of expansion and contraction of the expandable bodies and movement of the movable member which is moved by expansion and contraction of the expandable bodies are controlled more accurately.

In the positioning device of the present invention characterized in such a structure as described above, it is preferable that each of the expandable bodies has a substantially elliptic cross section in a direction perpendicular to the expanding and contracting directions.

With such a structure, it is possible to reduce not only a size of the expandable body in the above-described perpendicular direction, but also a size of the positioning device of the present invention in the above-described perpendicular direction. This reduces a thickness of the massager when the positioning device of the present invention is used in the massager.

As described above, when the cross section of the expandable body in the direction perpendicular to the expansion and contraction directions is of a substantially elliptic shape and the positioning device of the present invention further comprises a supporting member extending in the expansion and contraction directions of the expandable bodies and supporting ends of the expandable bodies opposite from the movable member to control the expansion and contraction directions of the expandable bodies and the movement of the movable member moved by the expansion and contraction of the expandable body more accurately, it is preferable that a portion of the supporting member extending in the expanding and contracting directions of the expandable bodies is extended along long side portions of peripheries of the expandable bodies in a state in which the supporting member is adjacent to the long side portions.

The expandable body having the substantially elliptic cross section tends to be bent in its short side at the time of expansion. However, the supporting member which is disposed as described above effectively suppresses the bending of the expandable body, effectively suppresses inefficiency of the expansion of the expandable body due to the bending, and effectively suppresses inaccuracy of the movement of the movable member moved by the expansion of the expandable body.

In the positioning device of the present invention characterized in such a structure as described above, it is preferable that the air path device and the valve device are formed into a closed loop which returns air in the expandable body disposed in one side of the movable member into the air supplying device while the expandable body disposed in the other side of the movable member is expanded by air supplying from the air supplying device.

With such a structure, since air is not discharged from the air path device to outer space when the expandable body is contracted, noise which is generated when the air is discharged from the air path device to outer space can be deleted.

In the positioning device of the present invention characterized in such a structure as described above, a pair of expandable bodies can be disposed on the opposite sides of the movable member.

By disposing the expandable bodies on the opposite sides of the movable member, it is possible to move the movable member stably.

A massager having the positioning device of the present invention characterized in such a structure as described above comprises:

- a chair body including a seat and a back rest;
- a guide member provided on the back rest;
- a movable member movably guided in up and down directions by the guide member;
- expandable bodies disposed at opposite sides of the movable member in its moving direction, for expanding and contracting by air pressure;
- an air supplying device;
- an air path device for bringing the air supplying device and the expandable bodies into communication with each other, and for supplying air from the air supplying device to the expandable bodies;
- a valve device provided in the air path device, for opening and closing the air path device and for holding the expandable bodies in arbitrary expanded states by a valve closing action: and
- a massage element provided on the movable member and projecting from a surface of the back rest to abut against a body of a person sitting on the chair body.

In the massager of the present invention characterized in such a structure as described above, the massage element can be provided such that it can project from or retract toward the surface of the back rest.

Since the massage element is moved together with the movable member, the massage element can rub a body of a person sitting on the chair body, and further the massage element which can project and retract as described above can press the body.

In the massager of the present invention characterized in such a structure as described above, the chair body can be provided with a plurality of massage bags, the plurality of massage bags can be in communication with the air supplying device by the air path device, and the air path device and the valve device can be structured such that the air path device and the valve device repeat supply of air from the air supplying device to the plurality of massage bags and discharge of air from the plurality of massage bags.

With such a structure, in the massager of the present invention, it is possible to massage the body of the user sitting on the chair body by using the plurality of massage bags in addition to the massage using the massage element. Further, the air supplying device for operating the expandable bodies to move the movable member having the massage element can be used to operate the plurality of massage bags. As a result, it is possible to reduce the manufacturing cost of the massager of the present invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

Various embodiments of the present invention will be explained in detail with reference to the accompanying various drawings.

DETAILED DESCRIPTION OF THE INVENTION

A first embodiment of the present invention will be explained with reference to FIGS. 1 to 4.

Figure 1:
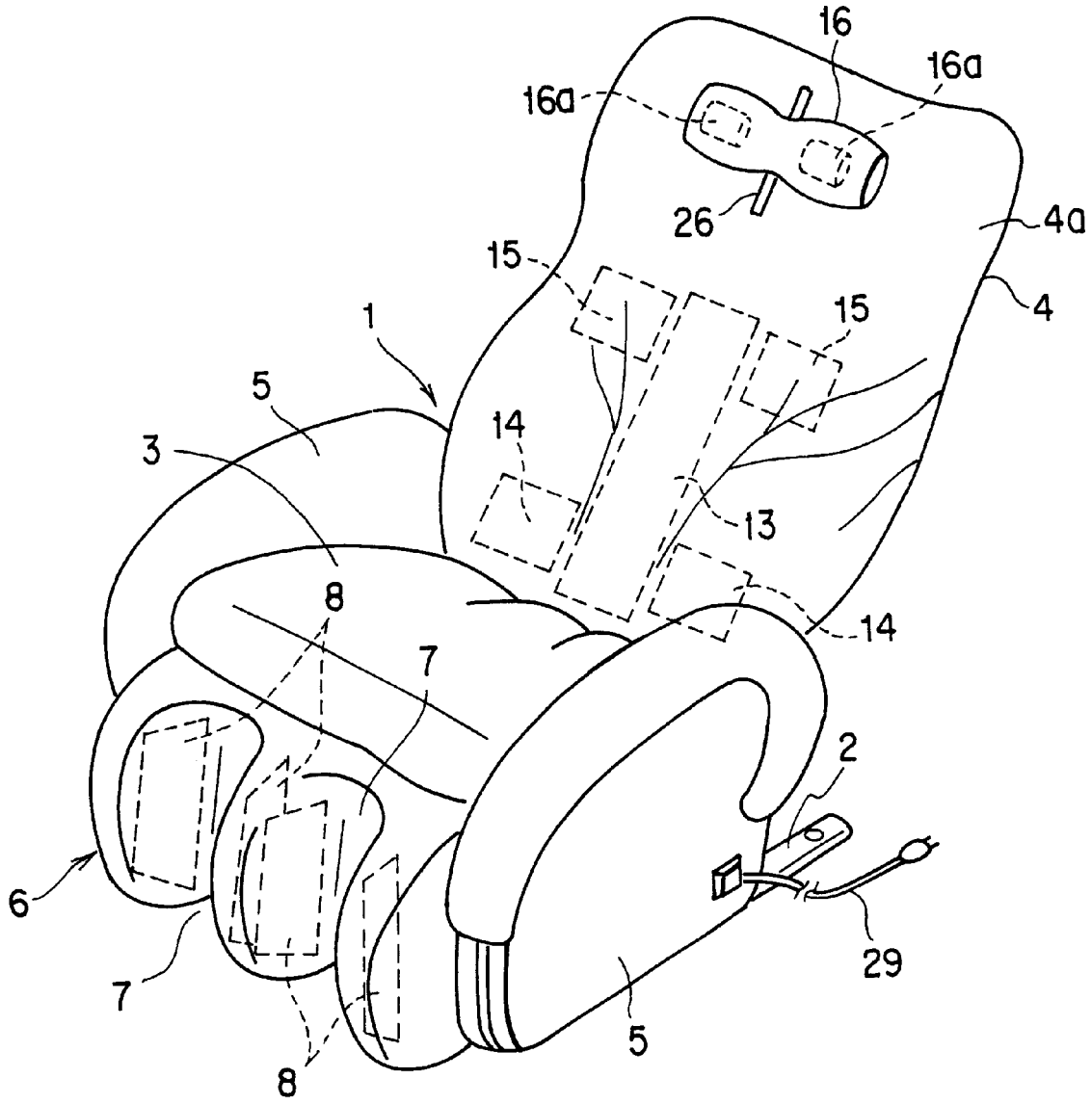
FIG. 1 is a perspective view showing a structure of a chair type air massager according to a first embodiment of the present invention.

In a chair type air massager according to the first embodiment of the present invention shown in FIG. 1, a chair body (massager body) 1 includes a body frame 2, a seat 3 mounted to the body frame 2 substantially horizontally, and a back rest 4 disposed in a back side of the seat 3 and extending rearwards and upwards. The back rest 4 is mounted to the body frame 2 through a reclining mechanism (not shown) such that an inclining angle of the back rest 4 to the seat 3 can be adjusted. However, the back rest 4 may be fixed to the body frame 2 such that the inclining angle of the back rest 4 to the seat 3 can not be adjusted. A pair of side plates 5 are disposed at right and left opposite sides of the body frame 2 to sandwich the seat 3, and an upper edge of each of the pair of side plates 5 functions as an arm rest.

A leg massage device 6 is mounted to a front portion of the body frame 2. The leg massage device 6 can be rotated in up and down directions between a first position where the leg massage device 6 is located at a front edge of the seat 3 to extend substantially downwards from the front edge in a vertical direction as shown in FIG. 1, and a second position where the leg massage device 6 is projected substantially forwards from the front edge of the seat 3 in a horizontal direction. The second position is not shown. The leg massage device 6 includes a pair of leg accommodating grooves 7, and leg massage bags 8 embedded in opposite side surfaces of each of the leg accommodating grooves 7. When the leg massage device 6 is disposed in the horizontal second position, calves of a user sitting on the chair body (massager body) 1 are accommodated in the leg accommodating grooves 7 of the leg massage device 6. These leg massage bags 8 are expanded and contracted by supplying and discharging high pressurized air to and from the leg massage bags 8, and repeat pressing and relaxing operations to the claves of the user accommodated in the leg accommodating grooves 7, thereby massaging the claves. In the massager of the present invention, the leg massage device 6 can be omitted.

As shown in FIGS. 2 and 3A to 3C, the back rest 4 includes a reversed U-shaped back rest frame 11, and a lower end portion of the back rest frame 11 is mounted to the body frame 2 through the above described reclining mechanism (not shown). A back plate 12 is mounted to a front side of the back rest frame 11, and a cushion material (not shown) is mounted to a front surface of the back plate 12. The back rest frame 11, the back plate 12 and the cushion (not shown) are covered with a back rest cover 4a (see FIG. 1).

Figure 3A:
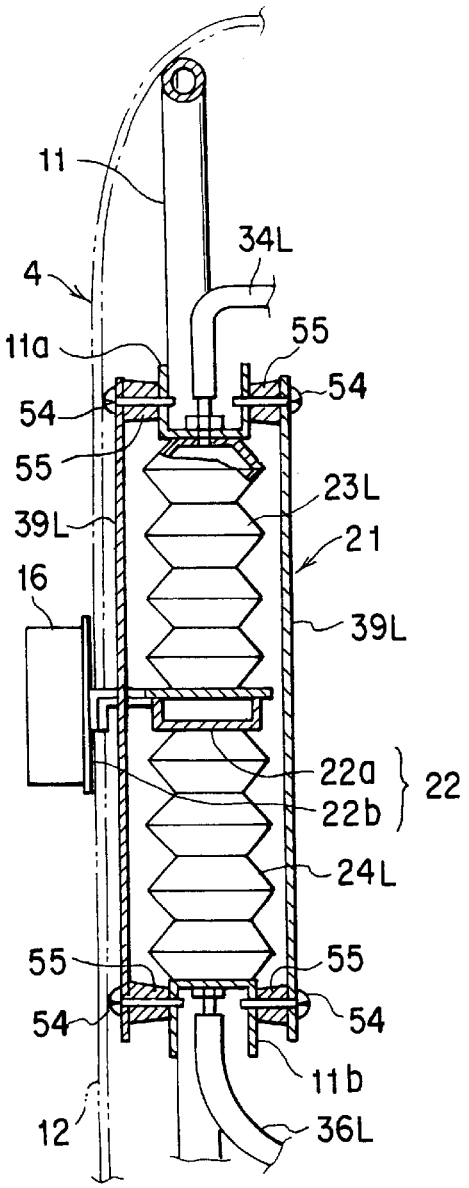
FIG. 3A is a vertical sectional view showing a structure of a massage element moving mechanism (a massage element positioning device) taken along a line IIIA—IIIA in FIG. 2.
Figure 3B:
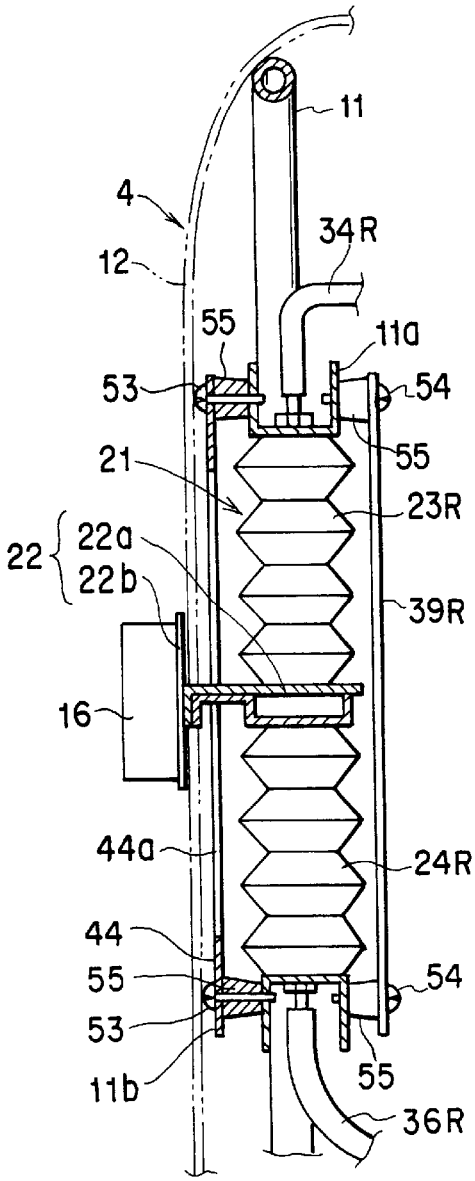
FIG. 3B is a horizontal sectional view showing the structure of the massage element moving mechanism (the massage element positioning device) taken along a line IIIB—IIIB in FIG. 2.

A pair of reinforcing frames 11*a* and llb horizontally extending at two positions separated from each other in up and down directions are fixed to an upper portion of the back rest frame 11 by screws 51 in the present embodiment, but these reinforcing frames may be fixed to the back rest frame by another fixing device such as welding. As shown in FIGS. 3A and 3B, the upper reinforcing frame 11*a* has a substantially square U-shaped cross section, and the lower reinforcing frame 11*b* has a substantially square reversed U-shaped cross section.

As shown in FIG. 1, massage bags for air massage are mounted to a front side of the back plate 12 of the back rest 4. In the illustrated example, a center back massage bag 13 is disposed in the back rest 4 at its center portion in the widthwise direction to extend in the up and down directions. In a lower portion of the back rest 4, a pair of lower back massage bags 14 are disposed in opposite sides of the center back massage bag 13, and in an upper portion of the back rest 4, a pair of shoulder massage bags 15 are disposed in opposite sides of the center back massage bag 13. These massage bags 13 to 15 are covered with the back rest cover 4*a*.

These massage bags 13 to 15 are expanded and contracted by supplying and discharging high pressurized air to and from these massage bags 13 to 15, and repeat pressing and relaxing operations to the center back, lower back and shoulders of the sitting user, thereby air massaging these portions of the back.

In the upper portion of the back rest 4, a movable massage element 16 which can move in the up and down directions with respect to the back rest 4 (in a longitudinal direction of the back rest 4) is disposed above the center back massage bag 13. The movable massage element 16 projects forwards from the back rest cover 4*a*. The movable massage element 16 is used for massaging a neck of the user sitting on the chair body (massager body) 1, and includes a pair of right and left neck massage bags 16*a*. These neck massage bags 16*a* are expanded and contracted by supplying and discharging high pressurized air to and from these neck massage bags 16*a*, and repeat pressing and relaxing operations to the neck of the sitting user, thereby air massaging the neck.

Compressed air is supplied to and discharged from the massage bags 8, 13 to 15 and 16*a* by a compressed air supplying device (not shown) provided in the chair body (massager body) 1.

Figure 2:
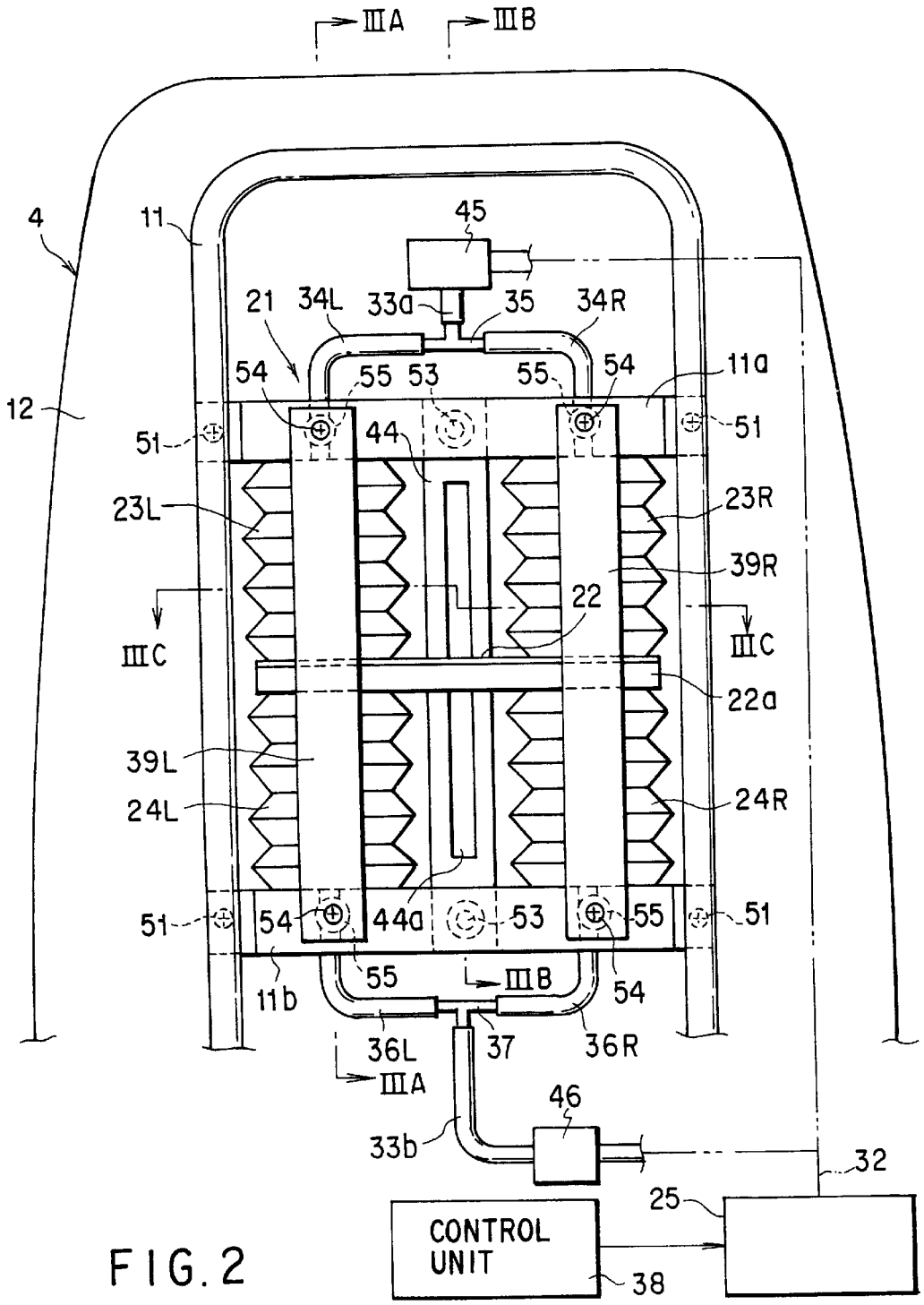
FIG. 2 is a rear view of an internal structure of an upper portion of a back rest of the massager shown in FIG. 1 with a back rest cover being removed.
Figure 3C:
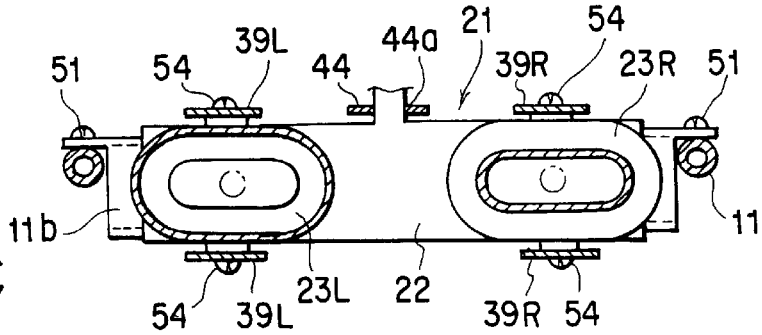
FIG. 3C is a horizontal sectional view showing the structure of the massage element moving mechanism (the massage element positioning device) taken along a line IIIC—IIIC in FIG. 2.
Figure 4:
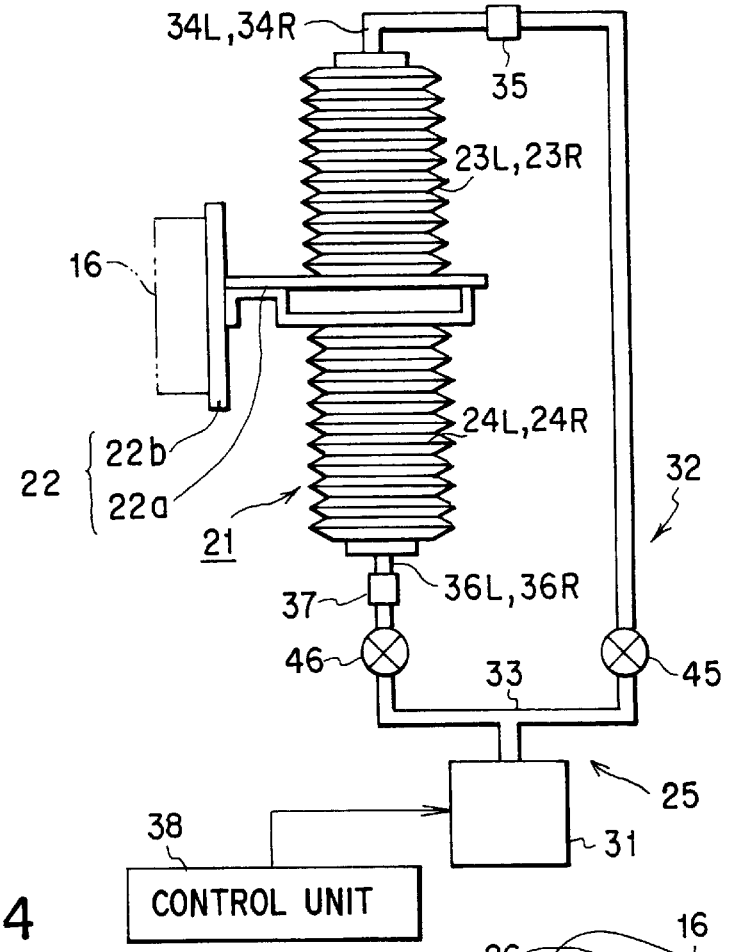
FIG. 4 is a schematic view showing the structure of the massage element moving mechanism (the massage element positioning device) to explain an operation of the massage element moving mechanism (the massage element positioning device) of the massager shown in FIG. 1.

The movable massage element 16 can move with respect to the back rest 4 in the up and down directions (in the longitudinal direction of the back rest 4) by a massage element moving device (positioning device) 21 shown in FIGS. 2 to 4.

Next, the massage element moving device 21 will be explained. In the present embodiment, the message element moving device 21 includes a moving table (movable member) 22, two sets of expandable bodies 23L and 24L as well as 23R and 24R, a compressed air supplying device 25, an air path device 32 including first and second solenoid valves 45 and 46 and being in communication with the compressed air supplying device 25 and the two sets of expandable bodies 23L and 24L as well as 23R and 24R, two sets of supporting members 39L and 39L as well as 39R and 39R for supporting the two sets of expandable bodies 23L and 24L as well as 23R and 24R, and a moving table guide 44 for guiding the movement of the moving table 22.

As shown in FIGS. 2 and 3B, the moving table guide 44 extends in the up and down directions, and longitudinally opposite ends thereof are fixed to longitudinally center portions of the pair of reinforcing frames 11*a* and 11*b* of the back rest 4 by screws 53 having spacers 55. This fixation may be carried out by another known fixing device including welding. The moving table guide 44 includes an elongated hole 44*a* extending in the longitudinal direction.

As shown in FIGS. 3A to 3C, the moving table 22 includes a table plate 22*a* extending in right and left directions, and a supporting plate 22*b* fixed to a front end of a connecting projection which projects forwards from a longitudinally center portion of the table plate 22*a*. The movable massage element 16 is mounted to the supporting plate 22*b*.

The connecting projection of the table plate 22*a* of the moving table 22 projects forwards from the back rest cover 4*a* through the elongated hole 44*a* of the moving table guide 44 and a slender hole 26 (FIG. 1) provided in a center of an upper portion of the back rest cover 4*a*. As a result, the supporting plate 22*b* at the front end of the connecting projection and the movable massage element 16 are located in front of the back rest cover 4*a*.

Each of the expandable bodies 23L and 24L as well as 23R and 24R is of bellows shape which is long in the up and down directions, and is expanded and contracted in the up and down directions by supplying and discharging the compressed air to and from each of the expandable bodies by the compressed air supplying device. Since the bellows shaped expandable bodies 23L and 24L as well as 23R and 24R can be integrally formed for example by blow molding, they have higher air-tightness as compared with a telescopic type expandable body, and air is not leaked. Therefore, the bellows shaped expandable bodies 23L and 24L as well as 23R and 24R can expand appropriately proportional to the supplied air amount or pressure, and it is possible to accurately define a direction and amount of expansion and contraction. The bellows shaped expandable bodies 23L and 24L as well as 23R and 24R make it possible to set their amount of expansion and contraction greater.

In the present embodiment, as shown in FIG. 2, a pair of expandable bodies 23L and 24L of one unit are disposed at upper and lower sides of the moving table 22 in a left side of a center of the back rest in the right and left directions when the back rest 4 is seen from its back side. The expandable body 23L is disposed at the upper side of the table plate 22*a* of the moving table 22, and the expandable body 24L is disposed at the lower side of the table plate 22*a*. A pair of expandable bodies 23R and 24R of the other unit are disposed at upper and lower sides of the moving table 22 in a right side of the center of the back rest in the right and left directions when the back rest 4 is seen from its back side. The expandable body 23R is disposed at the upper side of the table plate 22*a* of the moving table 22, and the expandable body 24R is disposed at the lower side of the table plate 22*a*.

An upper end (one end) of each of the upper side expandable bodies 23L and 23R is fixed to a lower surface of the upper side reinforcing frame 11*a* by adhesive or the like, and a lower end (the other end) of each of the upper side expandable bodies 23L and 23R is fixed to an upper surface of the table plate 22 by adhesive or the like. An upper end (one end) of each of the lower side expandable bodies 24L and 24R is fixed to a lower surface of the table plate 22*a* by adhesive or the like, and a lower end (the other end) of each of the lower side expandable bodies 24L and 24R is fixed to an upper surface of the lower side reinforcing frame 11*b* by adhesive or the like.

As shown in FIG. 3C, a cross section of each of the expandable bodies 23L and 24L as well as 23R and 24R in a direction perpendicular to the expansion and contraction directions is a substantially elliptic shape (including rectangular). Each of the expandable bodies 23L and 24L as well as 23R and 24R arranges a pair of long sides of the elliptic cross section in a thickness direction of the back rest 4. The expandable bodies 23L and 24L as well as 23R and 24R arranged in such a manner contribute reduction of a thickness of the back rest 4 and makes the back rest 4 compact.

According to a concept of the present invention, each of the expandable bodies 23L and 24L as well as 23R and 24R may arranges a pair of curved short sides in the thickness direction of the back rest 4. In this case, this arrangement contributes reduction of a size of the back rest 4 in its widthwise direction and makes the back rest 4 compact.

One pair of supporting members 39L and 39L of one unit are disposed in front of and behind the pair of upper and lower expandable bodies 23L and 24L, and are extended in the up and down directions adjacent to the pair of front and rear long sides of the pair of upper and lower expandable bodies 23L and 24L. Upper and lower opposite ends of each of the supporting members 39L and 39L are fixed to the pair of upper and lower reinforcing frames 11*a* and 11*b* by fixing screws 54 having spacers 55. This fixation may be carried out by another known fixing device including welding.

The other pair of supporting members 39R and 39R are disposed in front of and behind the other pair of upper and lower expandable bodies 23R and 24R, and are extended in the up and down directions adjacent to the pair of front and rear long sides of the other pair of upper and lower expandable bodies 23R and 24R. Upper and lower opposite ends of each of the supporting members 39R and 39R are fixed to the pair of upper and lower reinforcing frames 11*a* and 11*b* by fixing screws 54 having spacers 55. This fixation may be carried out by another known fixing device including welding.

Since each of the supporting members 39L, 39L as well as 39R and 39R is composed of a long and narrow flat plate, it is possible to reduce a thickness of the massage element moving device 21 and also reduce the thickness of the back rest 4 in which the massage element moving device 21 is embedded.

The compressed air supplying device 25 shown in FIGS. 2 and 4 for supplying and discharging the compressed air to and from the two sets of expandable bodies 23L, 24L and 23R, 24R comprises an air compressor 31 disposed in the back rest 4 and an air path device 32 which brings the expandable bodies 23L, 24L and 23R, 24R into communication with the air compressor 31.

The air path device 32 includes two air paths. The first air path comprises one branch 33*a* of a bifurcated discharge tube 33 connected to a discharge port of the air compressor 31, tubes 34L and 34R individually connected to the upper expandable bodies 23L and 23R, and a joint tube 35 for connecting the tubes 34L, 34R and the one branch 33*a* of the discharge tube 33. The second air path comprises the other branch 33*b* of the discharge tube 33, tubes 36L and 36R connected individually with the lower expandable bodies 24L and 24R, and a joint tube 37 for connecting the tubes 36L, 36R and the other branch 33*b* of the discharge tube 33.

In the first air path of the air path device, a first solenoid valve 45 is mounted to the one branch 33*a* of the bifurcated discharge tube 33. The first solenoid valve 45 can be switched between a first switching mode for bringing the corresponding upper pair of expandable bodies 23L and 23R and the discharge port of the air compressor 31 into communication with each other, a second switching mode for cutting the communication between the expandable bodies 23L and 23R and the discharge port of the air compressor 31 and for bringing the expandable bodies 23L and 23R into communication with atmosphere, and a third switching mode for cutting the communication between the expandable bodies 23L and 23R and the discharge port of the air compressor 31 and for cutting the communication between the expandable bodies 23L and 23R and atmosphere.

In the second air path device of the air path, a second solenoid valve 46 is mounted to the other branch 33*b* of the bifurcated discharge tube 33. The second solenoid valve 46 can be switched between a first switching mode for bringing the corresponding lower pair of expandable bodies 24L and 24R and the discharge port of the air compressor 31 into communication with each other, a second switching mode for cutting the communication between the expandable bodies 24L and 24R and the discharge port of the air compressor 31 and for bringing the expandable bodies 24L and 24R into communication with atmosphere, and a third switching mode for cutting the communication between the expandable bodies 24L and 24R and the discharge port of the air compressor 31 and for cutting the communication between the expandable bodies 24L and 24R and atmosphere.

Operations of the air compressor 31 and the first and second solenoid valves 45 and 46 are controlled by a control unit 38. The control unit 38 may be used for the massage element moving device 21 exclusively, or may also be used for the above-described compressed air supplying device (not shown) provided in the lower accommodating space under the seat 3 of the chair body (massager body) 1 to supply and discharge the compressed air to and from the massage bags 8, 13 to 15 and 16*a* (FIG. 1).

The control unit 38 can be operated by a remote controller (not shown), and information for adjusting a height of the movable massage element 16 is input to the control unit 38 through the remote controller (not shown).

FIG. 1 also shows a power source cord 29 for supplying electricity to various devices requiring electricity in the chair body (massager body) 1 including the compressed air supplying device 25 of the massage element moving device 21, the other compressed air supplying device (not shown) and the control unit 38.

An operation of the massage element moving device 21 characterized in the above-described structure will be explained.

In FIGS. 3A and 3B, the movable massage element 16 is disposed at an intermediate position in a movable range in the up and down directions, and the intermediate position is defined as a reference height position of the movable massage element 16.

To move the movable massage element 16 upwards from this reference height position, information for moving up the movable massage element is input to the control unit 38 through the remote controller (not shown). As a result, the control unit 38 brings the first solenoid valve 45 into the second switching mode and the second solenoid valve 46 into the first switching mode, and operates the air compressor 31. At this time, the compressed air discharged from the air compressor 31 is supplied to the lower expandable bodies 24L and 24R through the other branch 33*b* of the discharge tube 33, the second solenoid valve 46, the joint tube 37, and the tubes 36L and 36R. As a result, the lower expandable bodies 24L and 24R upwardly expand on the lower reinforcing frame 11*b* and move the moving table 22 together with the movable massage element 16 from the reference height position. During this time, air in the upper expandable bodies 23L and 23R which are pushed and contracted toward the upper reinforcing frame 11*a* by the moving table 22 is discharged to atmosphere through the tubes 34L and 34R, the joint tube 35 and the first solenoid valve 45 on the one branch 33*a* of the discharge tube 33 and therefore, the upward movement of the moving table 22 is not hindered.

The upward movement of the moving table 22 is stopped at an upper limit position which is determined by arrival of the lower expandable bodies 24L and 24R at their expansion limit, or arrival of the upper expandable bodies 23L and 23R at their contraction limit, or arrival of the forward projection of the table plate 22*a* of the moving table 22 at an upper end of the slender hole 44 of the moving table guide 44.

The moving table 22 together with the movable massage element 16 can be held at the upper limit position by keeping the operation of the compressed air supplying device 25 to supply the compressed air to the lower expandable bodies 24L and 24R continuously, or by bringing the lower second solenoid valve 46 into the third switching mode to cut the communication between the expandable bodies 24L and 24R and the discharge port of the air compressor 31, and also to cut the communication between the expandable bodies 24L and 24R and atmosphere. However, if the lower second solenoid valve 46 is brought into the third switching mode to stop the operation of the compressed air supplying device 25, it is possible to save operating energy of the compressed air supplying device 25 and to stably hold the movable massage element 16 at the upper limit position, as compared with the case in which the compressed air supplying device 25 is operated continuously.

Movement of the moving table 22 from the reference height position to an arbitrary position lower than the upper limit position can start in the same manner as the case when the moving platform 22 is moved from the reference height position to the upper limit position. That is, information for moving up the movable massage element is first input to the control unit 38 through the remote controller (not shown) and as a result, the control unit 38 brings the first solenoid valve 45 into the second switching mode and the second solenoid valve 46 into the first switching mode and operates the air compressor 31. Then, when the moving table 22 arrives at an arbitrary desired height position while the moving table 22 moves toward the upper limit position from the reference height position by the expansion of the lower expandable bodies 24L and 24R, the control unit 38 brings the first and second solenoid valves 45 and 46 into the third switching modes, and stops the operation of the air compressor 31.

The control unit 38 can know a height position of the movable massage element 16 relative to the surface of the back rest 4 by known detecting means which detects a relative position of the moving table 22 along the slender hole 44*a* of the moving table guide 44.

In order to move the moving massage element 16 down from the reference height position, information for moving the moving massage element down is input to the control unit 38 through the remote controller (not shown). As a result, the control unit 38 brings the second solenoid valve 46 into the second switching mode and the first solenoid valve 45 into the first switching mode, and operates the air compressor 31. At this time, the compressed air discharged from the air compressor 31 is supplied to the upper expandable bodies 23L and 23R through the one branch 33*a* of the discharge tube 33, the first solenoid valve 45, the joint tube 35 and the tubes 34L and 34R. As a result, the expandable bodies 23L and 24R expand downward below the upper reinforcing frame 11*a* and move the moving table 22 downwards together with the moving massage element 16. During this time, air in the lower expandable bodies 24L and 24R which are pushed and contracted toward the lower reinforcing frame 11*b* by the moving table 22 is discharged to atmosphere through the tubes 36L and 36R, the joint tube 37 and the second solenoid valve 46 on the other branch 33*b* of the discharge tube 33 and therefore, the downward movement of the moving table 22 is not hindered.

The downward movement of the moving table 22 is stopped at a lower limit position which is determined by arrival of the upper expandable bodies 23L and 23R at their expansion limit, or arrival of the lower expandable bodies 24L and 24R at their expansion limit, or arrival of the forward projection of the table plate 22*a* of the moving table 22 at a lower end of the slender hole 44 of the moving table guide 44.

The moving table 22 together with the movable massage element 16 can be held at the lower limit position by keeping the operation of the compressed air supplying device 25 to supply the compressed air to the upper expandable bodies 23L and 23R continuously, or by bringing the upper first solenoid valve 45 into the third switching mode to cut the communication between the expandable bodies 23L and 23R and the discharge port of the air compressor 31 and to cut the communication between the expandable bodies 23L and 23R and atmosphere. However, if the upper first solenoid valve 45 is brought into the third switching mode, it is possible to save the operating energy of the compressed air supplying device 25, and to stably hold the movable massage element 16 at the lower limit position, as compared with the case in which the compressed air supplying device 25 is kept operating.

Movement of the moving table 22 from the reference height position to an arbitrary position higher than the lower limit position can start in the same manner as the case when the moving table 22 is moved from the reference height position to the lower limit position. That is, information for moving down the movable massage element is first input to the control unit 38 through the remote controller (not shown) and as a result, the control unit 38 brings the second solenoid valve 46 into the second switching mode and the first solenoid valve 45 into the first switching mode, and operates the air compressor 31. Then, when the moving table 22 reaches an arbitrary desired height position while the moving table 22 moves toward the lower limit position from the reference height position by the expansion of the upper expandable bodies 23L and 23R, the control unit 38 brings the first and second solenoid valves 45 and 46 into the third switching modes, and stops the operation of the air compressor 31.

To return the moving table 22 to the reference height position from the arbitrary height position, information for returning the movable massage element to the reference height position is input to the control unit 38 through the remote controller (not shown). As a result, the control unit 38 controls the first and second solenoid valves 45 and 46 to supply the compressed air from the compressed air supplying device 25 to the upper expandable bodies 23L and 23R or the lower expandable bodies 24L and 24R, and at the same time to discharge the air to atmosphere from the upper expandable bodies 23L and 23R or the lower expandable bodies 24L and 24R to which the air is not supplied, so that the moving table 22 moves from the arbitrary height position toward the reference height position. Then, when the moving table 22 reaches the reference height position, the control unit 38 brings both the first and second solenoid valves 45 and 46 into the third switching modes, and stops the operation of the air compressor 31.

Although the massage element moving device 21 moves the moving table 22 in the up and down directions by using the two sets of upper and lower expandable bodies 23L, 23R, 24L and 24R in this embodiment, it is also possible to move the moving table 22 in the up and down directions by only one of the sets of the upper and lower expandable bodies, or by two or more sets of upper and lower expandable bodies. However, if only one of the sets of the upper and lower expandable bodies is used, a probability of malfunction due to damage is increased, and if two or more sets of expandable bodies are used, a number and weight of parts of the massage element moving device are increased, and an assembling operation is complicated.

Each of the two sets of expandable bodies 23L, 23R, 24L and 24R each having the substantially elliptic cross section has a tendency that side walls of the pair of long sides in the substantially elliptic cross section are easily bent during the expansion and contraction. However, in the present embodiment, such a tendency is effectively prevented by the two sets of supporting members 39L, 39L and 39R, 39R, each set extending adjacent to the side walls of the pair of long sides of each of the two sets of expandable bodies 23L, 23R, 24L and 24R.

For this reason, the expansion and contraction distance of each of the two sets of expandable bodies 23L, 23R, 24L and 24R is accurate, and it is possible to accurately control a movement of the moving table 22 together with the movable massage element 16.

Next, a structure and a function of a massage element moving device 21 according to a second embodiment of the present invention will be explained with reference to FIG. 5 which is similar to FIG. 2. Most of portions of the structure of the second embodiment are the same as most of portions of that of the above-described first embodiment. Therefore, in the second embodiment, structural elements which are the same as those of the first embodiment are designated with the same reference numerals designating structural elements in the first embodiment corresponding to the structural elements in the second embodiment, and detailed descriptions thereof are omitted.

A difference between the massage element moving device 21 of the second embodiment and that of the first embodiment is in the structure of the air path device 32 and in a connection relationship of the upper pair of expandable bodies 23L and 23R to the moving body 22.

In the second embodiment, the air path device 32 uses two discharge tubes 33*a* and 33*a*' which are formed independently from each other, instead of the bifurcated discharge tube 33. One end of one of the discharge tubes 33*a*, 33*a*' is not provided with a solenoid valve and is connected to an upstream side of the joint tube 35 of the first air path of the air path device 32, and one end of the other discharge tube 33*a*' is not provided with a solenoid valve and is connected to an upstream side of the joint tube 37 of the second air path of the air path device 32. The other end of each of the two discharge tubes 33*a* and 33*a*' is connected to the discharge port of the compressed air supplying device 25 through a rotary valve 25*a*.

Further, in the second embodiment, the lower end surfaces 23La and 23Ra of the upper expandable bodies 23L and 23R opposed to the upper surface of the table plate 22*a* of the moving member 22 are not fixed to the upper surface of the table plate 22*a* but are merely in contact with the upper surface of the table plate 22*a*.

Figure 5:
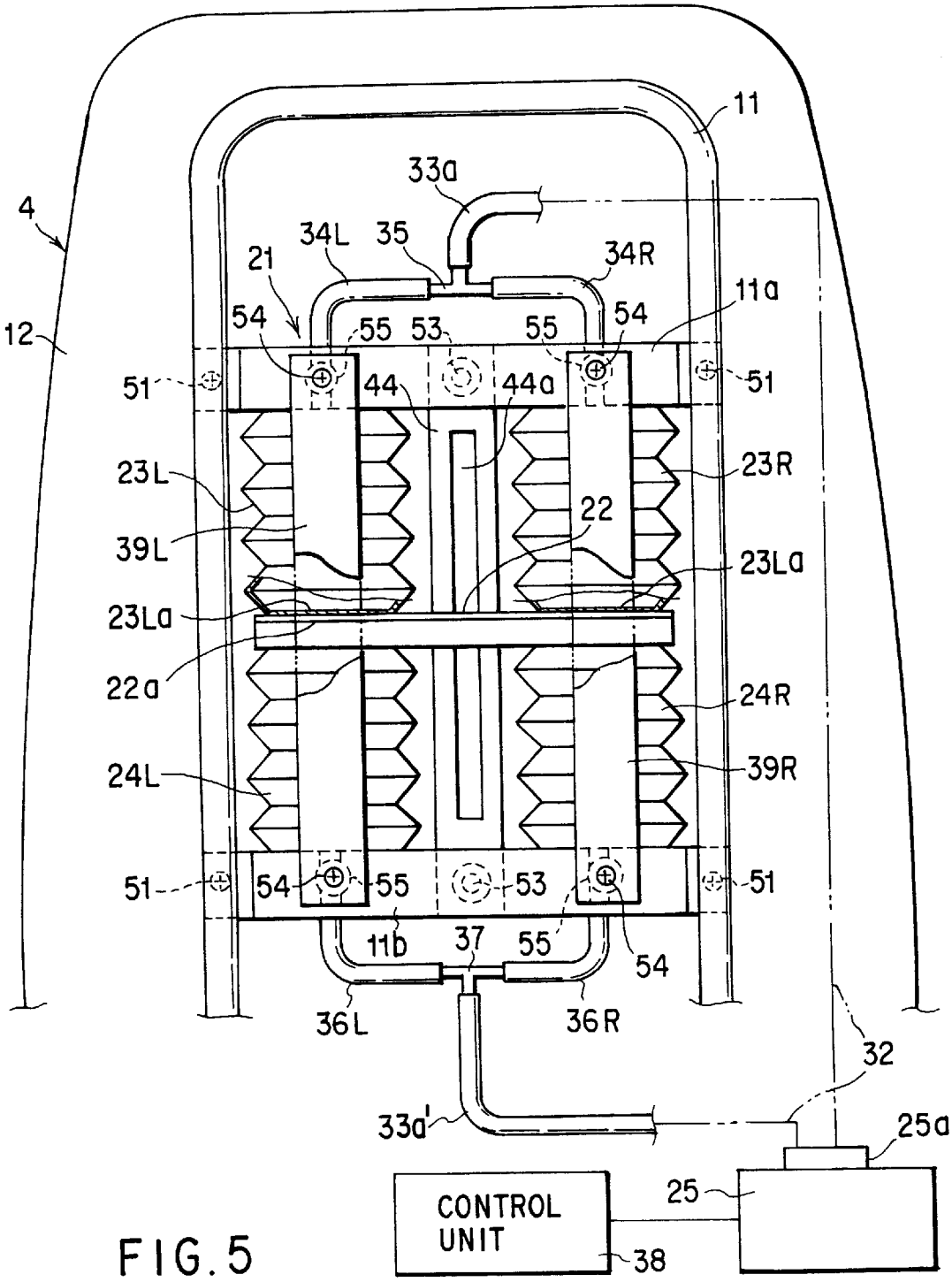
FIG. 5 is a rear view showing an internal structure of an upper portion of a back rest of a chair type air massager according to a second embodiment of the present invention with a back rest cover being removed.

In the second embodiment having the above-described structure, when the table plate 22*a* of the moving table 22 supporting the movable massage element is moved from a reference height position shown in FIG. 5 to an upper limit position, information for moving up the movable massage element is first input to the control unit 38 through the remote controller (not shown). Then, the control unit 38 connects the discharge port of the compressed air supplying device 25 to the other end of the joint tube 37 of the second air path through the other discharge tube 33*a*' by the rotary valve 25*a*, and opens the other end of the joint tube 35 of the first air path into an outer space through the one discharge tube 33*a*. As a result, the compressed air is supplied only to the pair of lower expandable bodies 24L and 24R from the compressed air supplying device 25, and these lower expandable bodies are expanded upwards up to their upper limit position. At this time, air in the upper expandable bodies 23L and 23R which are pushed and contracted through the table plate 22*a* of the moving member 22 by the upwardly expanding pair of lower expandable bodies 24L and 24R can flow out into atmosphere through the joint tube 35 and the one discharge tube 33*a* both of which being the first air path of the air path device 32, and the rotary valve 25*a*. Therefore, the upward movement of the moving body 22 is not hindered by the upper expandable bodies 23L and 23R.

In order to move the moving member 22 from the reference height position to an arbitrary height position between the reference height position and the upper limit position and to hold the moving member 22 at the arbitrary height position, information for moving up the movable massage element is input to the control unit 38 through the remote controller (not shown) in the same manner as the above-described case in which the moving member 22 is moved from the reference height position to the upper limit position. Then, the control unit 38 connects the discharge port of the compressed air supplying device 25 to the other end of the joint tube 37 of the second air path through the other discharge tube 33*a*' and opens the other end of the joint tube 35 of the first air path into atmosphere through the one discharge tube 33*a* by the rotary valve 25*a*. As a result, the compressed air is supplied to the pair of lower expandable bodies 24L and 24R from the compressed air supplying device 25 and the lower expandable bodies are extended upwards, and the moving member 22 is moved upwards from the reference height position. Immediately before the moving member 22 reaches the arbitrary height position higher than the reference height position, the control unit 38 cuts the connection between the other end of the joint tube 37 of the second air path and the discharge port of the compressed air supplying device 25 through the other discharge tube 33*a*' by the rotary valve 25*a*.

At this time, it is preferable that the other end of the joint tube 35 of the first air path is closed to the outer space and also to the discharge port of the compressed air supplying device 25 by the rotary valve 25*a*. With this structure, it is possible to hold the moving member 22 at the arbitrary height position more stably.

When the moving member 22 is moved from the reference height position toward a lower limit position, information for moving down the movable massage element is first input to the control unit 38 through the remote controller (not shown). The control unit 38 connects the discharge port of the compressed air supplying device 25 to the other end of the joint tube 35 of the first air path through the one discharge tube 33*a* and opens the other end of the joint tube 37 of the second air path to the outer space through the other discharge tube 33*a*' by the rotary valve 25*a*. As a result, the compressed air is supplied only to the pair of upper expandable bodies 23L and 23R from the compressed air supplying device 25, and the upper expandable bodies 23L and 23R are expanded downwards and extended to the lower limit position. At this time, air in the pair of lower expandable bodies 24L and 24R which are pushed and contracted through the table plate 22*a* of the moving member 22 by the downwardly expanding pair of upper expandable bodies 23L and 23R can flow out into atmosphere through the joint tube 37 and the other discharge tube 33*a*' both of which being the second air path of the air path device 32, and the rotary valve 25*a*. Therefore, the downward movement of the moving member 22 is not hindered by the lower expandable bodies 24L and 24R.

In order to move the moving member 22 from the reference height position to an arbitrary height position between the reference height position and the lower limit position and to hold the moving member 22 at the arbitrary height position, information for moving down the movable massage element is input to the control unit 38 through the remote controller (not shown) in the same manner as the above-described case in which the moving member 22 is moved from the reference height position to the lower limit position. Then, the control unit 38 connects the discharge port of the compressed air supplying device 25 to the other end of the joint tube 35 of the first air path through the one discharge tube 33*a* and opens the other end of the joint tube 37 of the second air path into atmosphere through the other discharge tube 33*a*' by the rotary valve 25*a*. As a result, the compressed air is supplied to the pair of upper expandable bodies 23L and 23R from the compressed air supplying device 25 and the upper expandable bodies are extended downwards and the moving member 22 is moved downwards from the reference height position. Immediately before the moving member 22 reaches the arbitrary height position lower than the reference height position, the control unit 38 cuts the connection between the other end of the joint tube 35 of the first air path and the discharge port of the compressed air supplying device 25 through the one discharge tube 33*a* by the rotary valve 25*a*.

At this time, it is preferable that the other end of the joint tube 37 of the second air path is closed to the outer space and is also closed to the discharge port of the compressed air supplying device 25 by the rotary valve 25*a*. With this structure, it is possible to hold the moving member 22 at the arbitrary height position more stably.

When the moving table 22 is returned to the reference height position from the arbitrary height position, information for returning the movable massage element to the reference height position is input to the control unit 38 through the remote controller (not shown). As a result, the control unit 38 controls the rotary valve 25*a* to supply the compressed air from the compressed air supplying device 25 to the upper expandable bodies 23L and 23R or the lower expandable bodies 24L and 24R, and at the same time, to discharge the air to atmosphere from the upper expandable bodies 23L and 23R or the lower expandable bodies 24L and 24R to which the air is not supplied, so that the moving table 22 moves from the arbitrary height position toward the reference height position. Then, when the moving table 22 reaches the reference height position, the control unit 38 controls the rotary valve 25*a* to stop the supply of the compressed air from the air compressor 31 to the upper expandable bodies 23L and 23R and the lower expandable bodies 24L and 24R, and to cut the communication between atmosphere and the upper expandable bodies 23L and 23R and the lower expandable bodies 24L and 24R. Further, the control unit 38 stops the operation of the air compressor 31.

Therefore, the massage element moving device 21 of the second embodiment can function in the same manner as that of the first embodiment. However, in the massage element moving device 21 of the second embodiment, the number of a control valve used for controlling the air path device 32 (the first and second solenoid valves 45, 46 in the first embodiment: the rotary valve 25*a* in the second embodiment) is smaller, its structure is easier, its weight is lighter and its manufacturing cost is lower, as compared with the first embodiment.

Further, in the second embodiment, since the lower ends of the upper expandable bodies 23L and 23R of the moving member 22 are not fixed to the upper surface of the table plate 22*a* of the moving member 22 but are merely in contact with the table plate 22*a*, the structure of the massage element moving device 21 of the second embodiment is further easier, and the manufacturing cost is further reduced. The reason why such a structure can be employed is that the weight of the moving member 22 together with the movable massage element 16 is always applied only to the upper end surfaces of the lower expandable bodies 24L and 24R, and the weight is not applied to the lower end surfaces of the upper expandable bodies 23L and 23R.

Next, a movable massage element positioning device according to a third embodiment of the present invention and a chair type massager provided with the positioning device will be explained with reference to FIGS. 6 to 9A and 9B.

Figure 6:
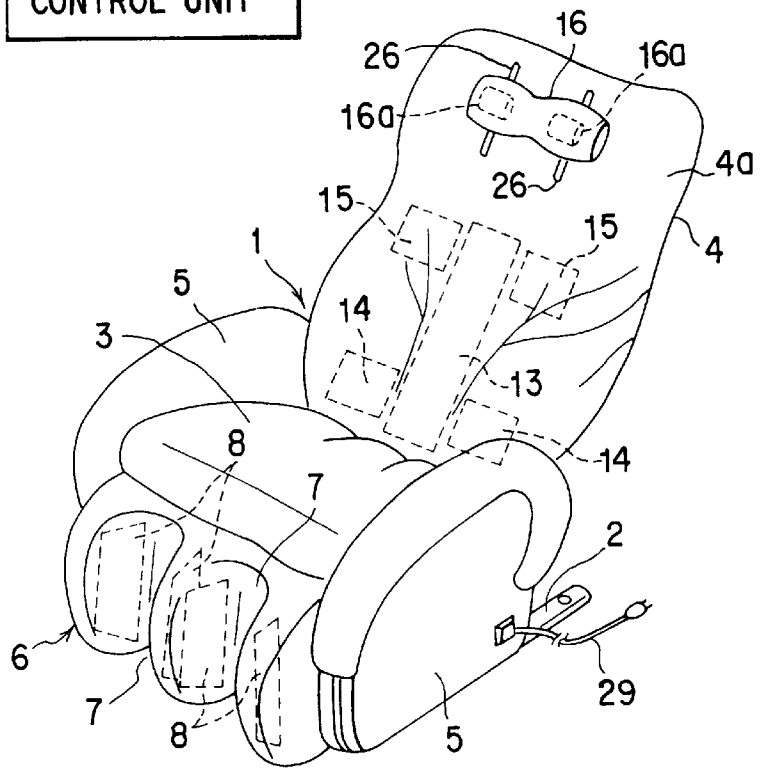
FIG. 6 is a perspective view showing a structure of a chair type air massager according to a third embodiment of the present invention.

As shown in FIG. 6, a structure of the chair type massager is almost the same as the structure of the chair type massager provided with the movable massage element positioning device according to the first embodiment of the invention shown in FIG. 1, excepting a structure of the movable massage element positioning device. Therefore, in the chair type massager shown in FIG. 6, structural elements which are the same as those of the chair type massager shown in FIG. 1 are designated with the same reference numerals as those used to designate structural elements of the first embodiment corresponding to the structural elements of the third embodiments, and detailed descriptions thereof are omitted.

As shown in FIG. 6, the chair type massager is different from the chair type massager shown in FIG. 1, excepting the structure of the movable massage element positioning device, only in that the number of connecting members (not shown in FIG. 6) which connect the movable massage element 16 disposed on the surface of the back rest cover 4*a* in the upper portion of the back rest cover 4*a* with the movable massage element positioning device of the third embodiment disposed in the back rest 4 is two and therefore, in the back rest cover 4*a*, two slender holes 26 are formed for allowing the vertical movements of the two connecting members.

Next, a structure and a function of the massage element moving device according to the third embodiment will be explained with reference to FIGS. 7A to 9B.

Figure 7B:
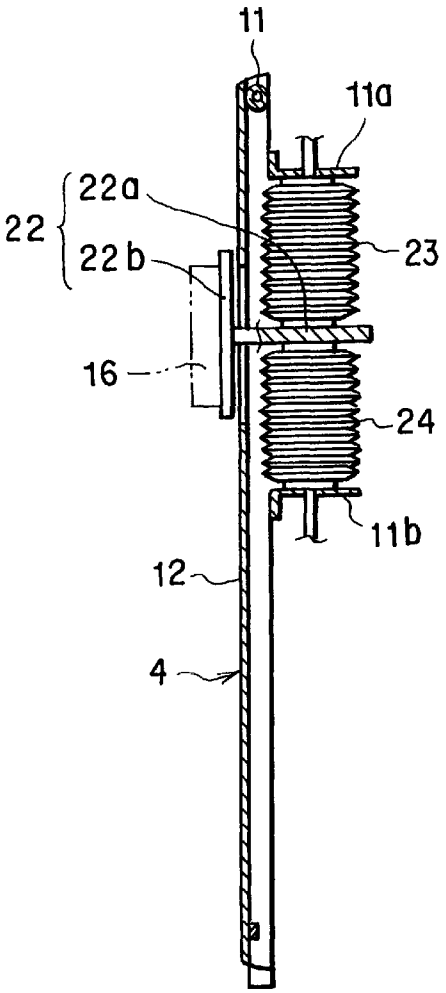
FIG. 7B is a vertical sectional view taken along a line VIIB—VIIB in FIG. 7A.
Figure 7A:
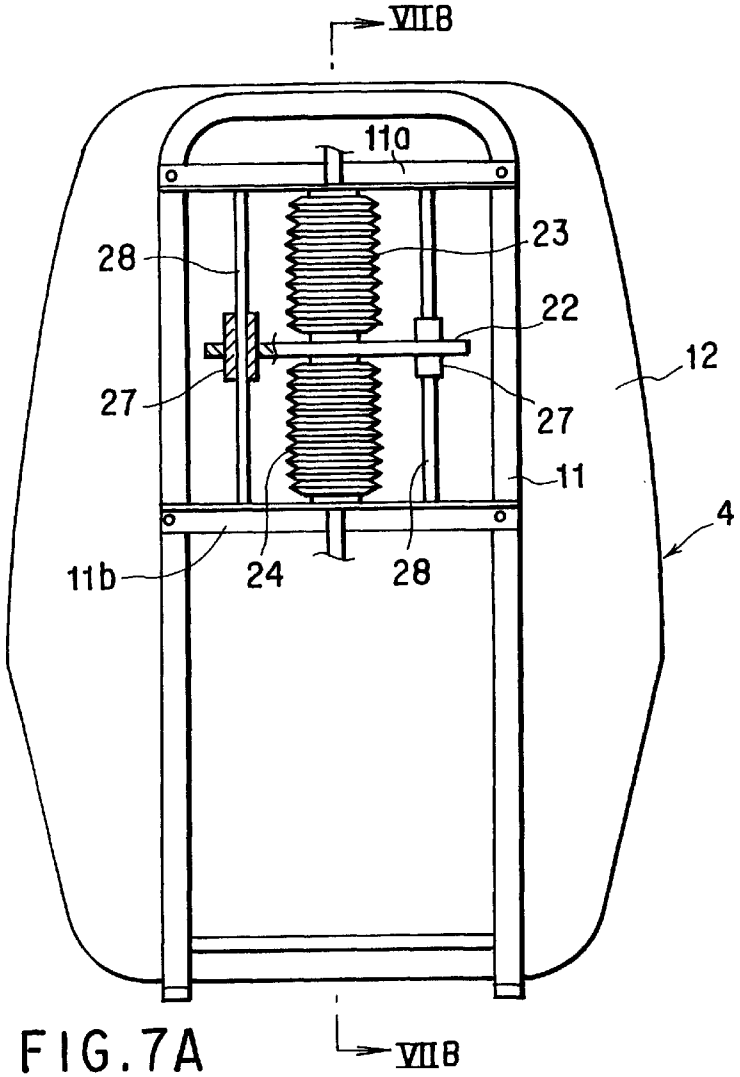
FIG. 7A is a rear view showing an internal structure of a back rest of a massager shown in FIG. 6 with a back rest cover being removed.

As shown in FIGS. 7A and 7B, the moving table 22 connects with the table plate 22*b* through a pair of forwardly projecting connecting projections of the table plate 22*a* and forms a T-shape as viewed in a side view. The movable massage element 16 is mounted to a front surface of the table plate 22*b*. The pair of connecting projections pass through a pair of slender holes 26 formed in the upper portion of the back rest cover 4*a*. The table plate 22*a* is provided at its widthwise opposite ends with sliding cylinders 27. As shown in FIG. 7A, these cylinders 27 are slidably fitted on a pair of guide shafts 28 extending in the up and down directions of the back rest 4. The pair of guide shafts 28 are parallel to each other, and upper and lower opposite ends of the guide shafts 28 are connected to the reinforcing frames 11*a*, 11*b* horizontally extending in parallel to each other. Therefore, the moving table 22 is mounted to the back rest 4 to be movable in the up and down directions.

Expandable bodies 23 and 24 expand and contract by air pressure, and each employs a bellows shape having a circular cross section in a direction perpendicular to the expansion and contraction directions in the illustrated example. These expandable bodies 23 and 24 are individually disposed on opposite sides of the moving table 22 in its moving direction, more particularly, on both sides of the table plate 22*a*, and one end of each of the expandable bodies is connected to the table plate 22*a* by adhesive or the like, and the other end thereof is connected to the reinforcing frame 11*a* or 11*b* by adhesive or the like. The expandable bodies 23 and 24 disposed upper and lower opposite sides of the table plate 22*a* move the moving table 22 by their expansion and contraction.

The compressed air supplying device 25 shown in FIGS. 8A, 8B, 9A and 9B is used for supplying and discharging the compressed air to and from the pair of expandable bodies 23 and 24, and includes the air compressor 31 disposed behind the back rest 4, and the air path device 32 connecting the air compressor 31 with the expandable bodies 23 and 24. The air path device 32 includes the bifurcated discharge tube 33 connected to the discharge port of the air compressor 31, a communication tube 36 provided such that its opposite ends are connected to one end and the other end of the tube 33 through the first and second solenoid valves 45 and 46, and a circulation tube 37 provided to connect the tube 36 and the inlet port of the air compressor 31.

One end of the bifurcated discharge tube 33 is connected to the expandable body 24 through the second solenoid valve 46. The second solenoid valve 46 is composed of a three-port solenoid valve, and selects one of a first switching mode which brings the expandable body 24 and the discharge port of the air compressor 31 into communication with each other, and a second switching mode which brings the expandable body 24 and the communication tube 36 into communication with each other. In the first switching mode, the communication between the expandable body 24 and the communication tube 36 is cut, and in the second switching mode, the communication between the expandable body 24 and the discharge port of the air compressor 31 is cut.

The other end of the bifurcated discharge tube 33 is connected to the expandable body 23 through the first solenoid valve 45. The first solenoid valve 45 is composed of a three-port solenoid valve, and selects one of a first switching mode which brings the expandable body 23 and the discharge port of the air compressor 31 into communication with each other, and a second switching mode which brings the expandable body 23 and the communication tube 36 into communication with each other. In the first switching mode, the communication between the expandable body 23 and the communication tube 36 is cut, and in the second switching mode, the communication between the expandable body 23 and the discharge port of the air compressor 31 is cut.

In the present embodiment, the air path device 32 is formed into a closed loop piping system in which the compressed air is not discharged out of the air path device 32 even if the air is supplied to or discharged from the pair of expandable bodies 23 and 24. The air compressor 31 and both the solenoid valves 45 and 46 are controlled by the control unit 38 (this control unit 38 may be used for the massage element positioning device 21 exclusively, or may also be used to control another compressed air supplying/discharging device (not shown) for the various massage bags 8, 13 to 15, 16*a* and 16*b* of the chair body 1). Necessary input information such as input information concerning change of a desired height position of the movable massage element 16 is sent to the control unit 38 by operating the remote controller (not shown). In FIG. 6, the reference numerals 29 denotes the power source cord.

Next, a moving up operation and moving down operation of the movable massage element 16 to adjust a position of the movable massage element 16 to a desired position of a neck of a user sitting on the chair body 1 of the chair type air massager shown in FIG. 6 will be explained.

Figure 8B:
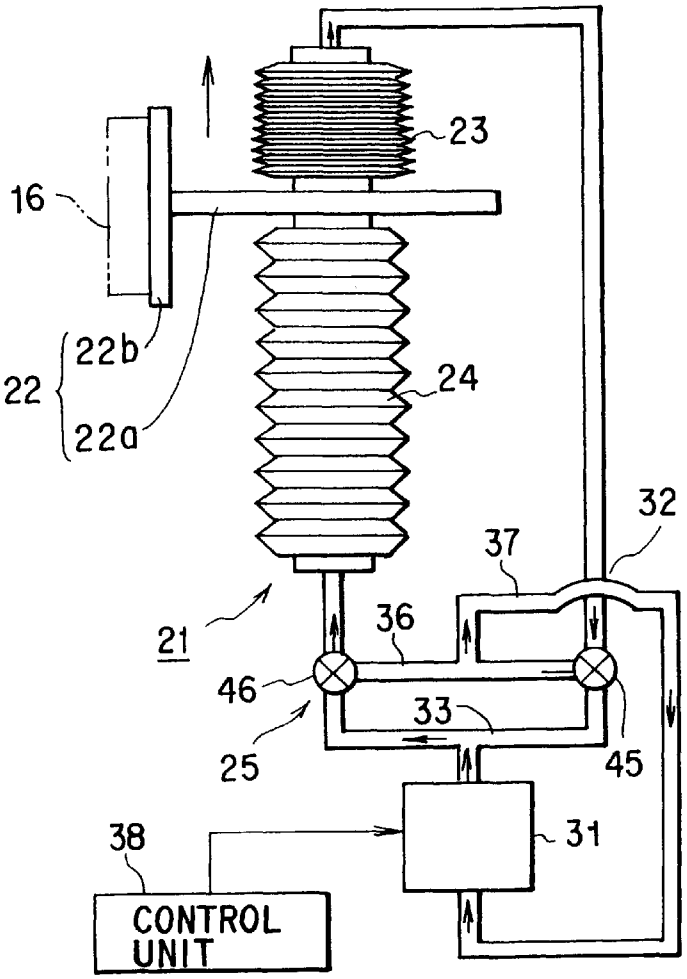
FIG. 8B is a view for explaining an operation of the massage element moving mechanism (the massage element positioning device) while the massage element moving mechanism (the massage element positioning device) is moving up the movable massage element from the reference height position in the massager shown in FIG. 6.
Figure 8A:
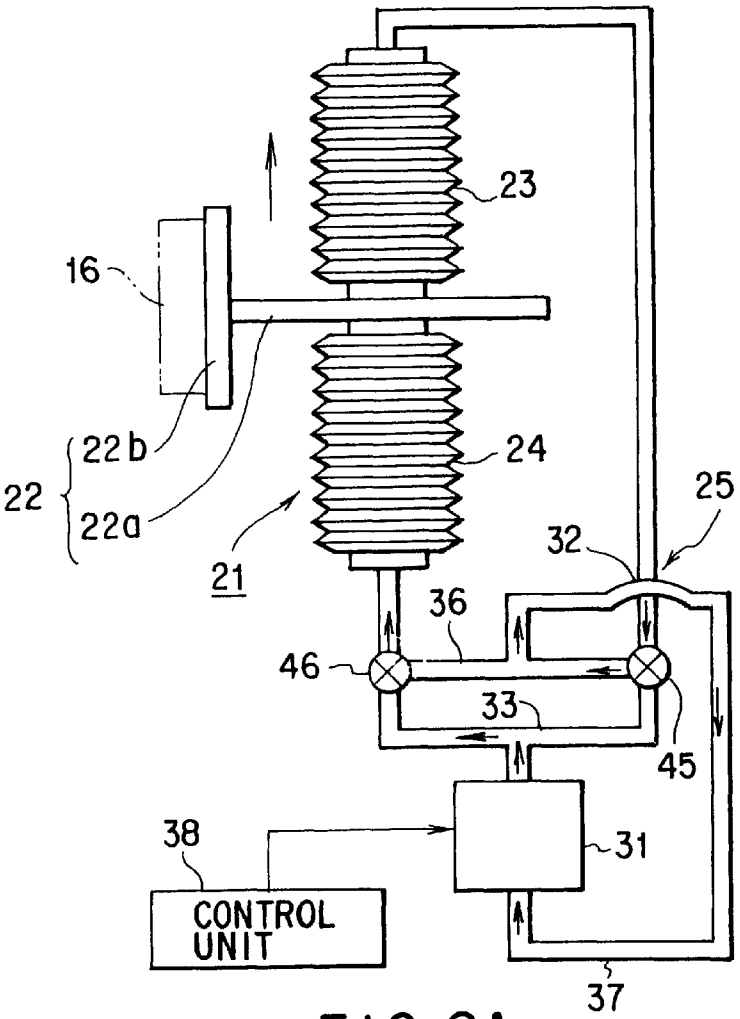
FIG. 8A is a view for explaining an operation of a massage element moving mechanism (a massage element positioning device) when the massage element moving mechanism (the massage element positioning device) starts to move up a movable massage element from a reference height position in the massager shown in FIG. 6.

To move up the moving table 22 supporting the movable massage element 16 from the reference height position shown in FIG. 8A, input information for moving up is sent to the control unit 38. Then, the control unit 38 brings the second solenoid valve 46 into the first switching mode and the first solenoid valve 45 into the second switching mode, and operates the air compressor 31. Therefore, the compressed air discharged from the compressor 31 is supplied to the lower expandable body 24 through the discharge tube 33 and the second solenoid valve 46, and the expansion body 24 expands upwards and at the same time, air in the upper expandable body 23 correspondingly pushed and contracted is discharged from the expandable body 23. The air discharged in this manner passes through the discharge tube 33 and the first solenoid valve 45, and flows into the circulation tube 37 through the communication tube 36. Therefore, the discharged air is drawn into the air compressor 31 through the tube 37.

Since the lower expandable body 24 expands and extends upwardly and at the same time the upper expandable body 23 contracts by the above-described air flow (shown with arrows in FIGS. 8A and 8B), the moving table 22 can be moved upwards as shown in FIG. 8B to adjust the position of the movable massage element 16 supported on the table 22 to the desired position of the neck of the user.

Figure 9B:
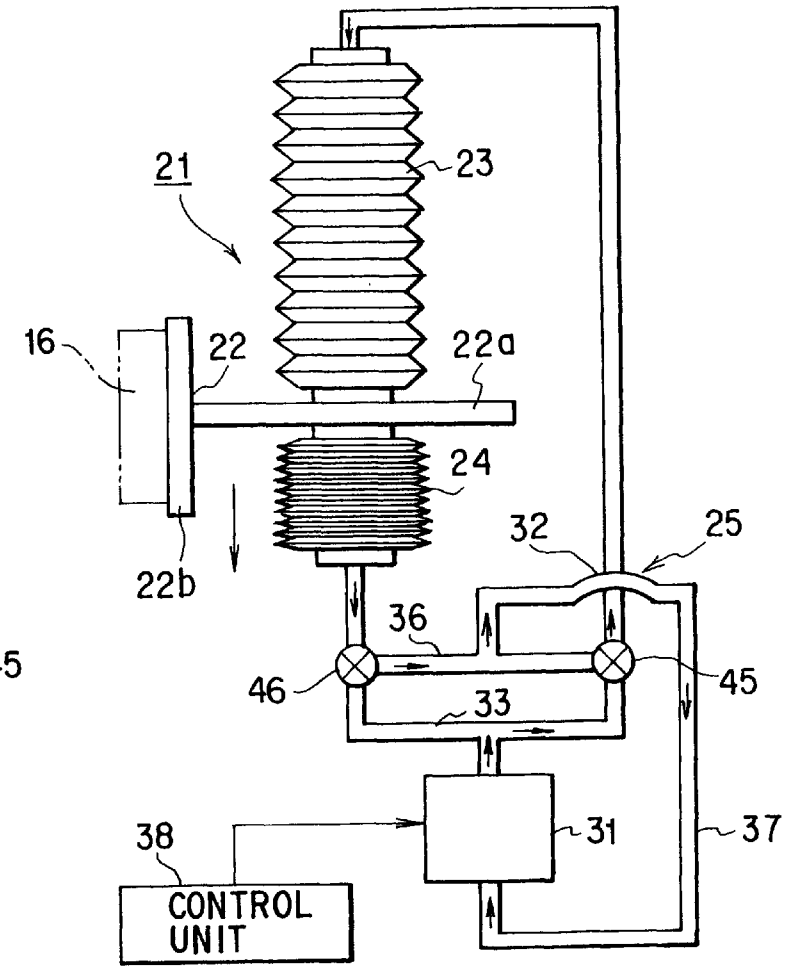
FIG. 9B is a view for explaining an operation of the massage element moving mechanism (the massage element positioning device) while the massage element moving mechanism (the massage element positioning device) is moving down the movable massage element from the reference height position in the massager shown in FIG. 6.
Figure 9A:
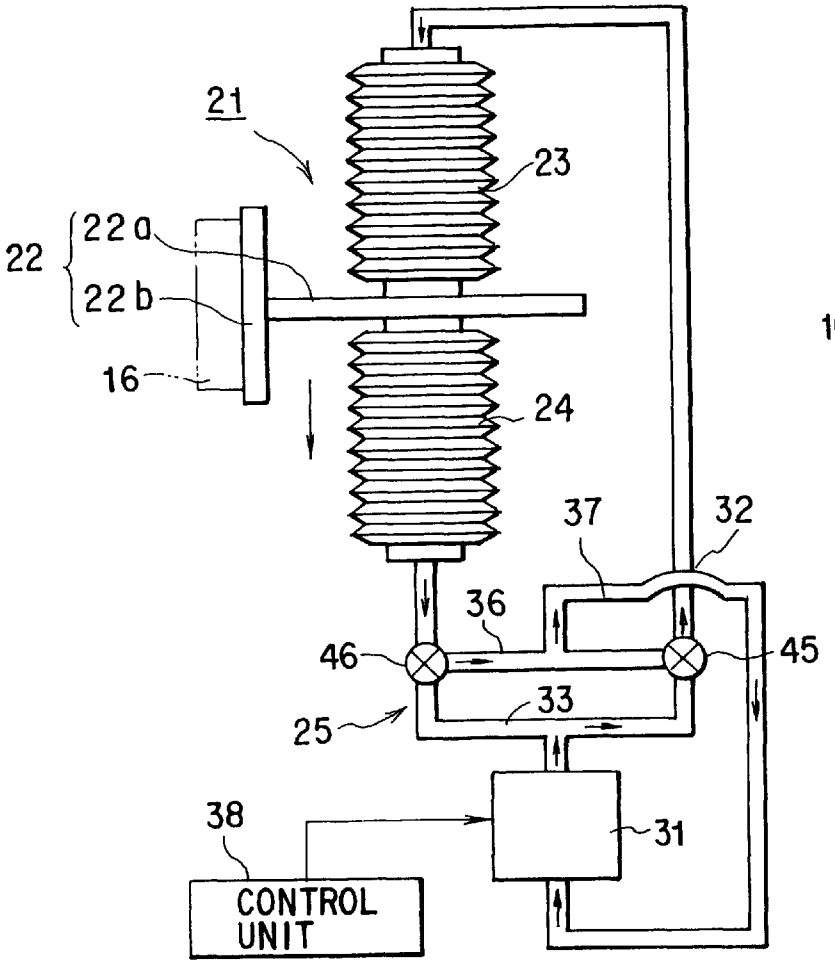
FIG. 9A is a view for explaining an operation of the massage element moving mechanism (the massage element positioning device) when the massage element moving mechanism (the massage element positioning device) starts to move down the movable massage element from the reference height position in the massager shown in FIG. 6.

To move down the moving table 22 supporting the movable massage element 16 from the reference height position shown in FIG. 9A, input information for moving down is sent to the control unit 38. Then, the control unit 38 brings the second solenoid valve 46 into the second switching mode and the first solenoid valve 45 into the first switching mode, and operates the air compressor 31. Therefore, the compressed air discharged from the compressor 31 is supplied to the upper expandable body 23 through the discharge tube 33 and the first solenoid valve 45, and the expandable body 23 expands downwards and at the same time, air in the lower expandable body 24 correspondingly pushed and contracted is discharged from the expandable body 24. The air discharged in this manner passes through the discharge tube 33 and the second solenoid valve 46, and flows into the circulation tube 37 through the communication tube 36. Therefore, the air is drawn into the air compressor 31 through the tube 37.

Since the upper expandable body 23 expands and extends downwardly and at the same time, the lower expandable body 24 contracts by the above-described air flow (shown with arrows in FIGS. 9A and 9B), the moving table 22 is moved downwards as shown in FIG. 9B to adjust the position of the movable massage element 16 supported on the table 22 to the desired position of the neck of the user.

Therefore, after the height position of the movable massage element 16 is adjusted in the above-described manner, it is possible to perform air massage to the neck at the desired appropriate position by expanding or contracting the neck massage bags 16*a*.

In the above description, two cases in which the movable massage element 16 is moved to the upper and lower limit positions are explained. When both the solenoid valves 45 and 46 are brought into the first switching modes by the control unit 38, the pair of expandable bodies 23 and 24 can be simultaneously expanded to be balanced with each other so that, the movable massage element 16 is moved to a center position in the height direction and is held at the center position. Further, if both the solenoid valves 45 and 46 are brought into the first and second switching modes by the control unit 38 at different timings, the movable massage element 16 can be moved to an arbitrary position between the center position and the upper limit position or the lower limit position. Since the volume of air in the air path device 32 of the closed loop is always constant in each of the height adjustment operations, it is possible to stop the movable massage element 16 at the adjusted height position and hold the element there.

According to the massage element positioning device 21 operated in the above-described manner, the movable massage element 16 is moved with respect to the back rest 4 by the moving table 22 in accordance with a degree of extension and contraction of the pair of expandable bodies 23 and 24, so that it is unnecessary to use an electric motor generating operation noise and an expensive reduction gear mechanism generating meshing noise when the movable massage element is moved and positioned. Therefore, it is possible to reduce the noise generated during the movable massage element 16 is moved, and to reduce the manufacturing cost of not only the massage element positioning device 21 but also the massager including the device 21.

Especially, in the present embodiment, the air path device 32 of the compressed air supply device 25 is formed into the closed loop piping system which draws air discharged from one of the pair of expandable bodies 23 and 24 which contracts when the other expandable body receives the compressed air supplied from the air compressor 31 and expands and extends. Therefore, air should not be discharged out from the air path device 32 and air discharging noise should not be generated and thus, it is possible to further reduce the noise generated when the massage element positioning device 21 is operated.

Figure 10:
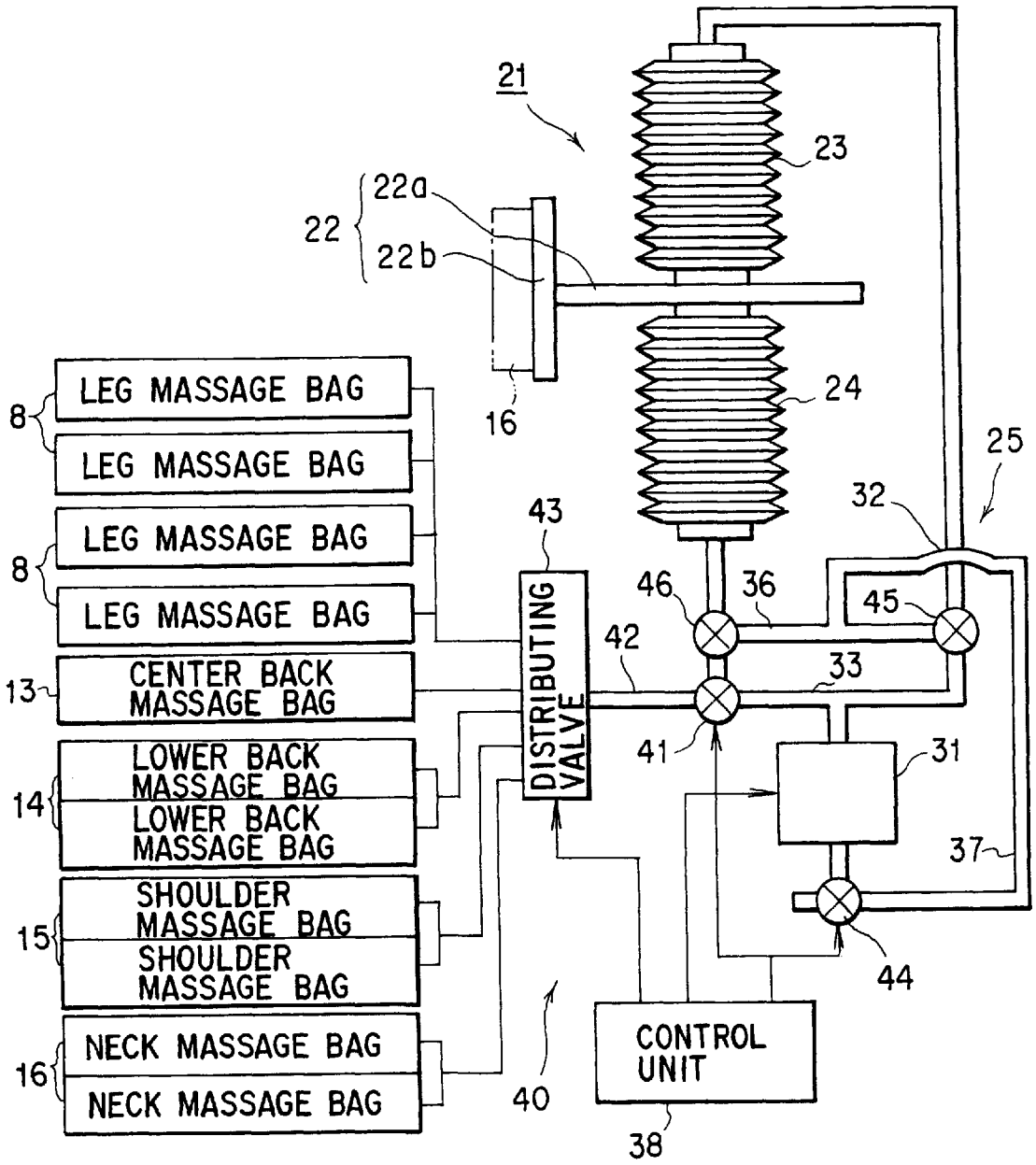
FIG. 10 is a schematic view showing a structure for operating a massage element moving mechanism (a massage element positioning device) and various massage bags in a massager according to a fourth embodiment of the present invention.

FIG. 10 shows a fourth embodiment of the present invention. Since a structure of this embodiment is basically the same as that of the third embodiment, structural elements which are the same as those of the third embodiment are designated with the same reference numerals as those used to designate structural elements of the third embodiment corresponding to the structural elements of the fourth embodiment, detailed descriptions thereof are omitted, and different portions will be explained. The difference between the fourth embodiment and the third embodiment is in that a compressed air supplying device for the massage element positioning device 21 and a compressed air supplying device for various massage bags of the chair body 1 commonly use an air compressor.

That is, in the fourth embodiment, the air compressor 31 is disposed in the lower space of the seat 3, a third solenoid valve 41 is mounted on the discharge tube 33 connected to the discharge port of the air compressor 31 at a position closer to the air compressor 31 than the first solenoid valve 45. A distributing valve 43 is connected to the valve 41 through an air tube 42. The distributing valve 43 is composed of a rotary valve having a releaf port, and various massage bags 8, 13 to 15 and 16 of the chair body 1 are connected to discharge ports of the distributing valve 43 through air tubes. The third solenoid valve 41 composed of a three-ports solenoid valve selects one of a first switching mode in which the discharge port of the air compressor 31 is brought into communication with the second solenoid valve 46 and the communication of the discharge port with the air tube 42 is cut, and a second switching mode in which the discharge port of the air compressor 31 is brought into communication with the air tube 42 and the communication of the discharge port with the second solenoid valve 46 is cut.

A fourth solenoid valve 44 is mounted on the circulation tube 37 connected to the inlet port of the air compressor 31. The fourth solenoid valve 44 composed of a three-ports solenoid valve selects one of a first switching mode in which the inlet port of the air compressor 31 is brought into communication with the circulation tube 37 and the communication of the inlet port with atmosphere is cut, and a second switching mode in which the inlet port of the air compressor 31 into communication with atmosphere and the communication of the inlet port with the circulation tube 37 is cut.

The fourth solenoid valve 44 and the third solenoid valve 41 are switched in association with each other by the control unit 38. That is, when the third solenoid valve 41 selects the first switching mode, the fourth solenoid valve 44 also selects the first switching mode, so that the air path device 32 is operated as a closed loop and the movable massage element 16 can be moved. When the third solenoid valve 41 selects the second switching mode, the fourth solenoid valve 44 also selects the second switching mode, so that outer air can be drawn into the air compressor 31 and air can be supplied to or discharged from at least one of the various massage bags 8, 13 to 15 and 16.

The air compressor 31, the air tube 42, the distributing valve 43 and the control unit 38 are included in the compressed air supplying device 40. The structures other than those described above are the same as those of the third embodiment including portions not shown in FIG. 10.

According to the fourth embodiment, when the movable massage element 16 is moved, both the third and fourth solenoid valves 41 and 44 select the first switching modes by the control unit 38 to bring the air path device 32 into the closed loop. Therefore, it is possible to perform the same action as that of the third embodiment, so that the movable massage element 16 together with the moving table 22 is moved by air pressure to dispose the movable massage element 16 at a desired height position of the back rest 4. Next, the control unit 38 selects the second switching modes for both the third and fourth solenoid valves 41 and 44, so that the compressed air discharged from the air compressor 31 is supplied to or discharged from any of the massage bags through the distributing valve 43 without influencing the pair of expandable bodies 23 and 24. As a result, any of the massage bags are expanded or contracted so that portions of a body of a user corresponding to the any of the massage bags can be massaged by pressing and relaxing.

Therefore, in this fourth embodiment, the same action and effect as those of the third embodiment can be obtained. Further, in the fourth embodiment, the compressed air supplying device 25 for the massage element positioning device 21 and the compressed air supplying device 40 for the various massage bags of the chair body 1 commonly use the one air compressor 31. Therefore, since the number of air compressors to be used can be reduced as compared with the third embodiment, it is possible to further reduce the manufacturing cost of the chair type massager correspondingly.

Next, a fifth embodiment of the present invention will be explained in detail with reference to FIGS. 11 to 18.

Figure 11:
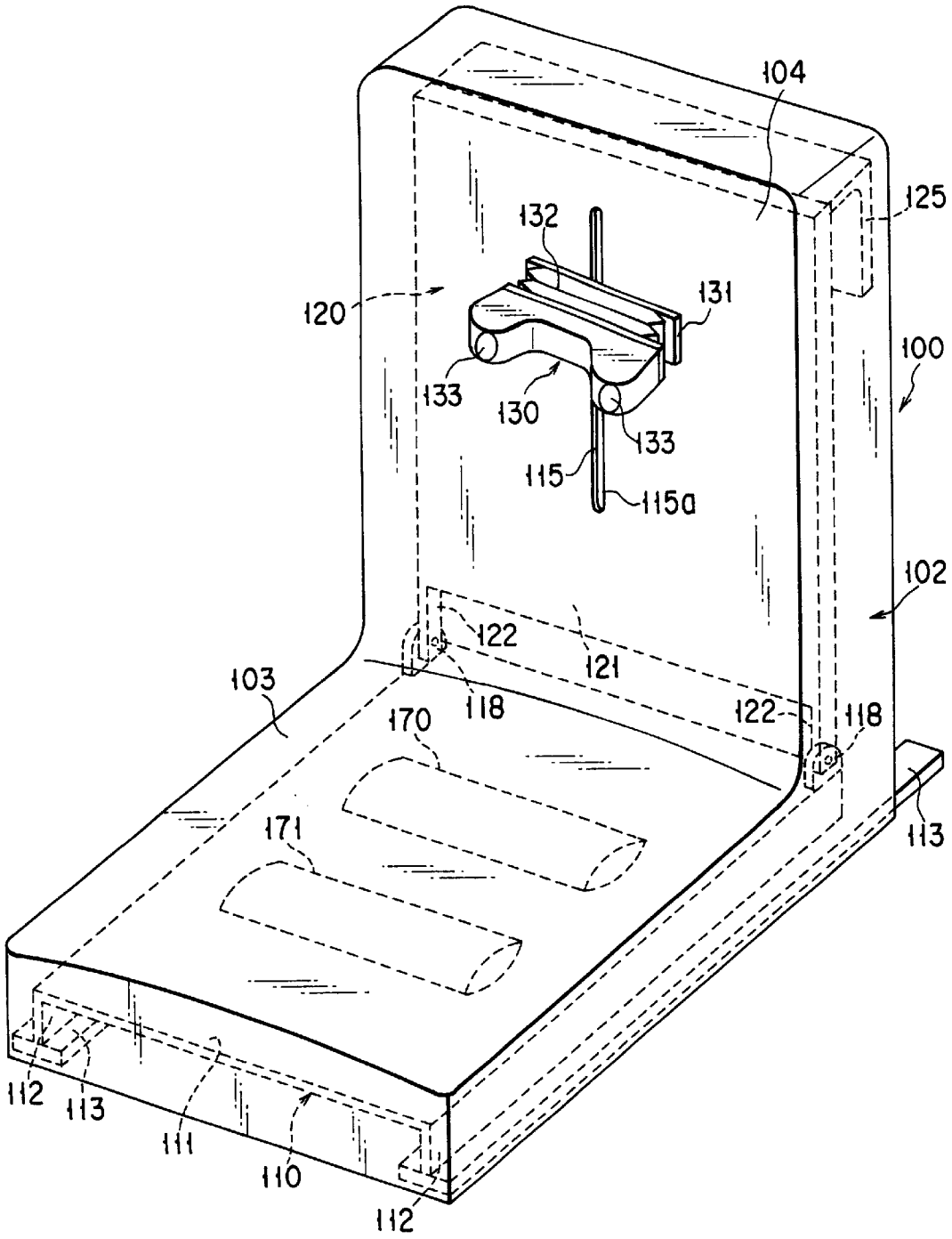
FIG. 11 is a perspective view showing a structure of a legless chair type air massager according to a fifth embodiment of the present invention.

FIG. 11 is a perspective view of a legless chair type massager 100. This legless chair type massager 100 includes a chair body (which will be merely referred to as a "body" hereinafter) 102 having a seat 103 and a back rest 104 provided at a rear end of the seat 103, a massage element 130 provided in the body 102, a moving mechanism 140 for moving the massage element 130, air bags 146 for moving the massage element 130, and a compressed air supplying/discharging device 160 for supplying and discharging air to and from the air bags 146.

Figure 12:
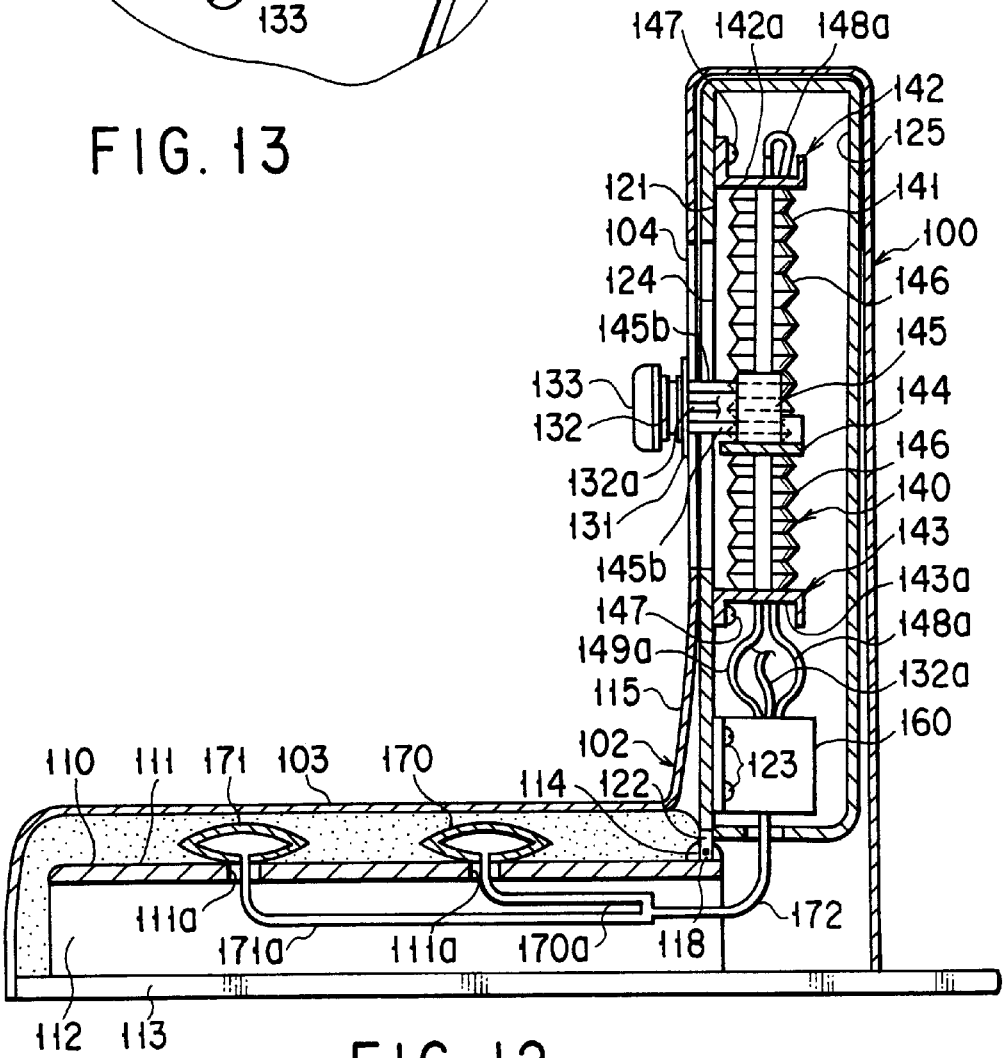
FIG. 12 is a vertical sectional view of the legless chair type massager shown in FIG. 11.

As shown in FIG. 12, the body 102 includes a seat plate 110, a back frame 120 pivotally supported by the seat plate 110 through shafts 118, and a thick soft member 117 made of expanded urethane foam or the like for covering the seat plate 110 and the back frame 120.

As shown in FIG. 11 with broken lines, the seat plate 110 includes an upper surface plate 111 and side surface plates 112 which are formed by benting of opposite sides of the upper surface plate 111 downwards, and has a reversed square U-shape when it is viewed from a front side thereof. Lower end edges of the side surface plates 112 are mounted to supporting legs 113.

Rear end of each of the supporting legs 113 extends rearwards from the back rest 104 by a predetermined length, and this structure prevents the body 102 from falling rearwards.

As shown in FIG. 12, two through holes 111*a* are formed in the upper surface plate 111 to pass hoses 170*a* and 170*a* therethrough, and a pair of bearings 114 having shaft holes are formed in opposite side ends of a rear portion of the upper surface plate 111.

As shown in FIGS. 11 and 12, a buttocks air bag 170 for massaging buttocks and a thigh air bag 171 for massaging thighs are disposed on the upper surface plate 111. One ends of the hoses 170*a* and 170*a* passing through the through holes 111*a* are connected to these buttocks air bag 171 and thigh air bag 171. The other ends of the hoses 170*a* and 170*a* are connected to the compressed air supplying/discharging device 160.

After the buttocks air bag 170 and the thigh air bag 171 are disposed on the upper surface plate 111 and the soft member 117 is disposed on the buttocks air bag 170 and the thigh air bag 171, the soft member 117 is covered with a cover 115 made of cloth or the like, so that the upper surface of the upper surface plate 111 constitutes the seat 103.

A slit 115*a* is formed in a center portion of the cover 115. Columnar projections 145*b* of a connecting member 145 which will be explained in detail in the follows pass through the slit 115*a*.

As shown in FIG. 11 with broken lines, the back frame 120 includes a back plate 121 formed into a rectangular shape and a pair of projections 122 which are integrally formed with opposite sides of a lower portion of the back plate 121. Shaft holes are formed in the pair of projections 122. By rotatably coupling the shaft holes to the bearings 114 formed on the upper surface plate 111 of the seat plate 110 with the shafts 118, the back frame 120 is mounted to the seat plate 110 around the shafts 118 as a rotation fulcrum.

The back frame 120 which can rotate around the shafts 118 as the rotation fulcrum can be positioned at an arbitrary angle by a rotation angle adjusting mechanism (not shown). With this structure, the back rest 104 can be positioned at an arbitrary position.

Figure 13:
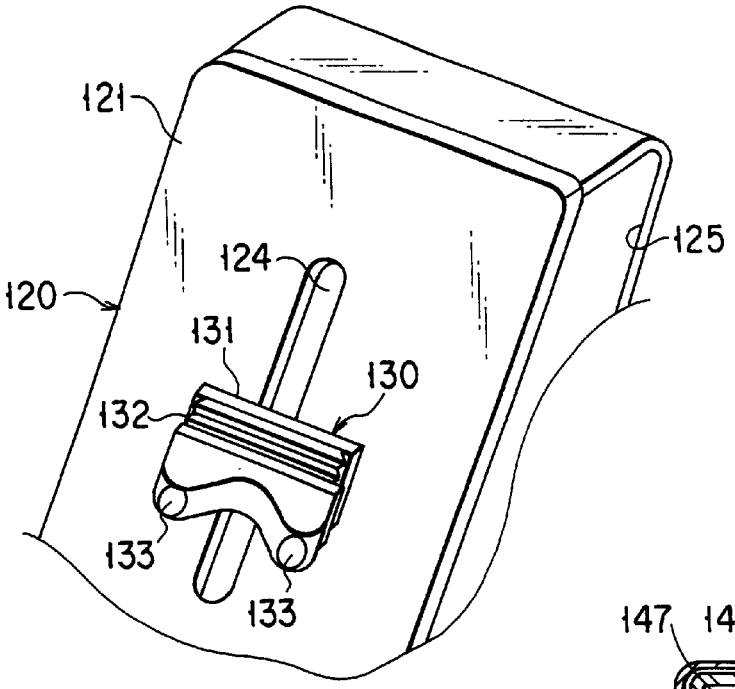
FIG. 13 is an enlarged perspective view of a massage element in a back frame of a back rest of the legless chair type massager shown in FIG. 11.

As shown in FIG. 13, a guide groove 122 is formed in the back frame 120 to extend along the up and down directions at a central portion of the back frame in the right and left directions. The guide groove 122 allows the connecting member 145 (not shown in FIG. 13) to move along it when the massage element 130 moves in the up and down directions as it will be explained in detail latter.

Next, the massage element positioning device 140 for adjusting the position of the massage element 130 will be explained in detail.

Figure 14:
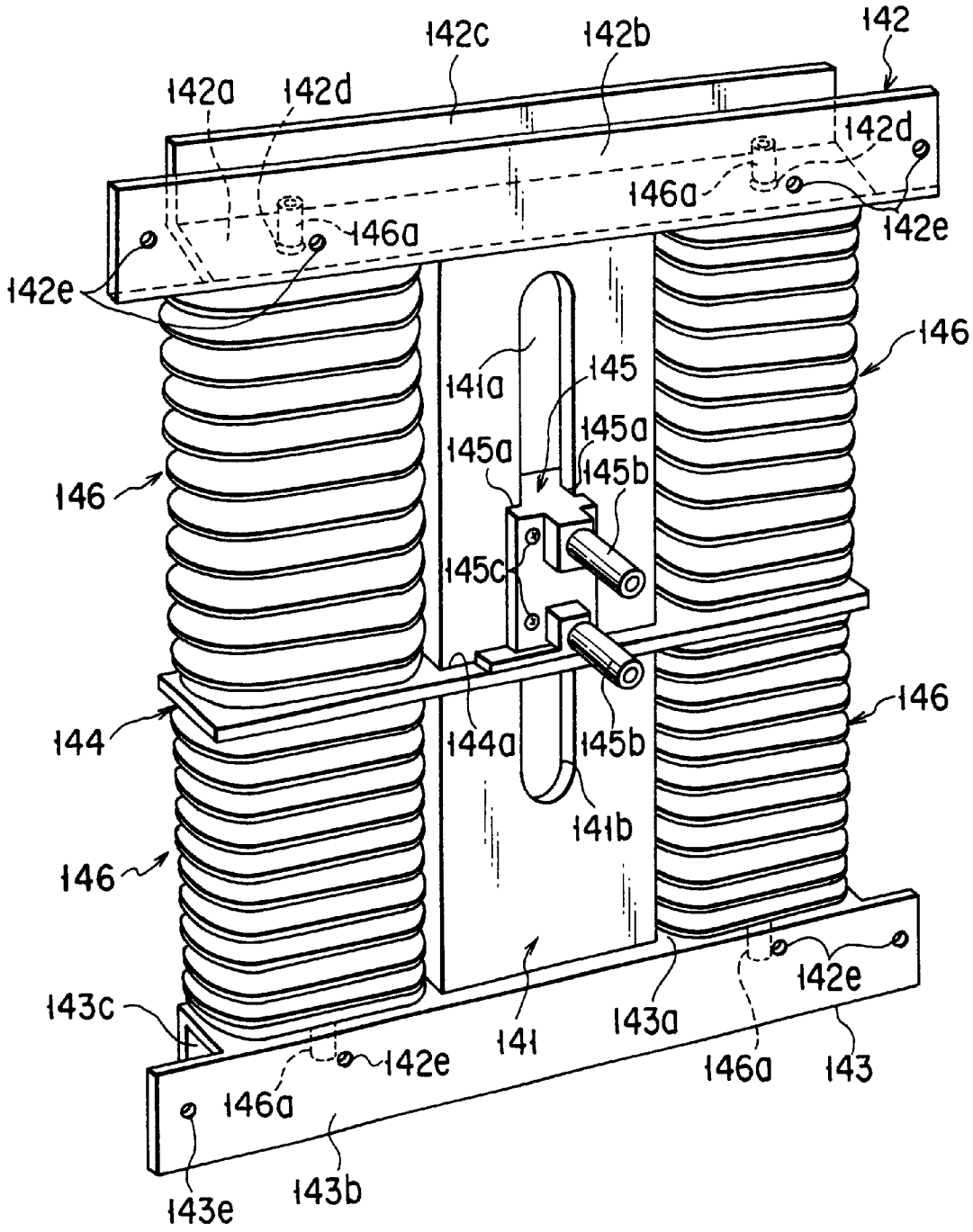
FIG. 14 is a perspective view of a massage element moving mechanism (a massage element positioning device) of the legless chair type massager shown in FIG. 11 as viewed from a front side of the back rest.
Figure 15:
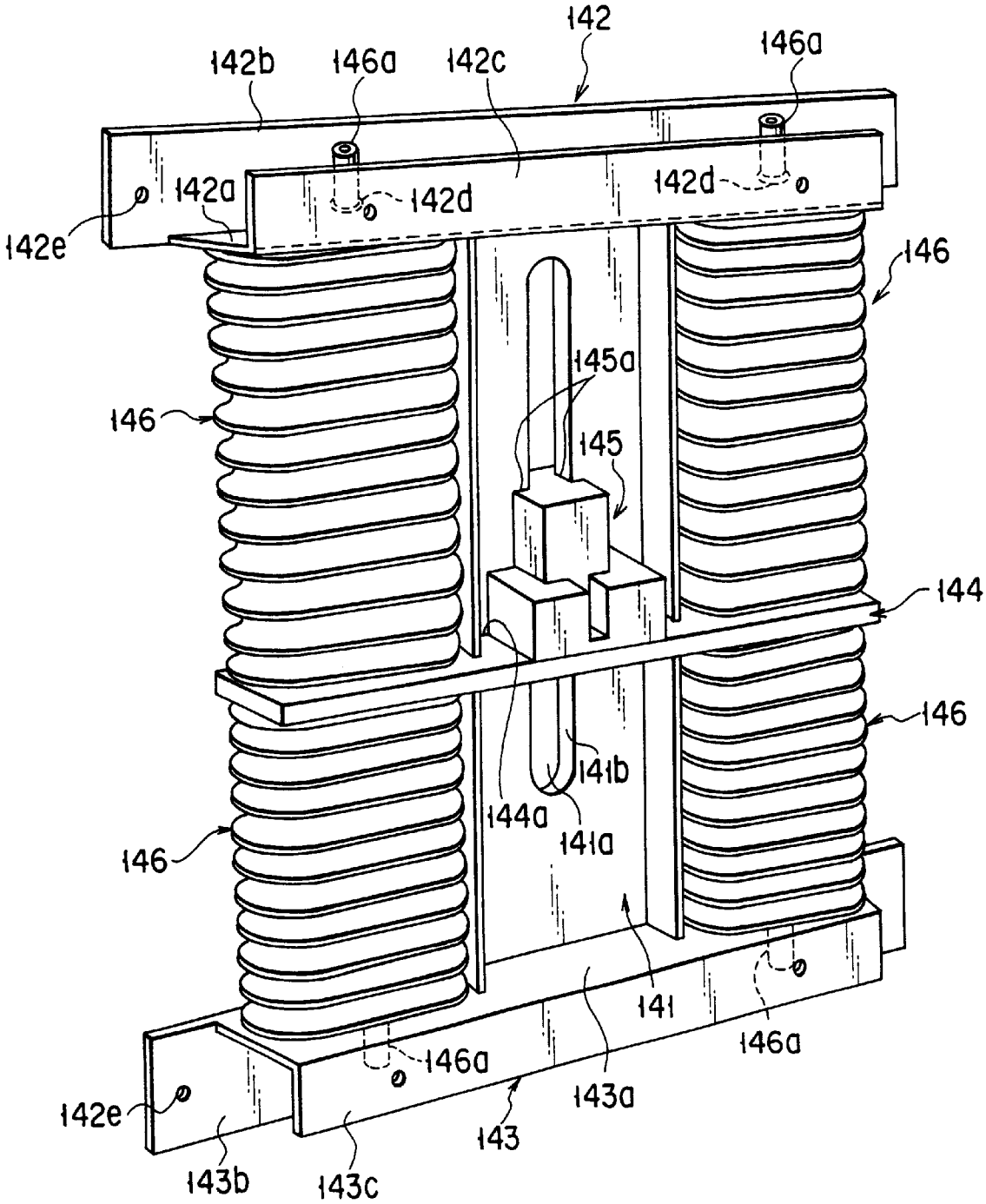
FIG. 15 is a perspective view of the massage element moving mechanism (the massage element positioning device) of the legless chair type massager shown in FIG. 11 as viewed from a back side of the back rest.

As shown in FIGS. 12, 14 and 15, the massage element positioning device 140 includes a slender frame 141 as a guide member, an upper frame 142 fixed to an upper end of the slender frame 141 by welding or the like, a lower frame 143 fixed to a lower end of the slender frame 141 by welding or the like, a moving frame 144 as a moving member which moves in the up and down directions along the slender frame 141, the connecting member 145 as a supporting member integrally mounted to the moving frame 144, and air bags 146.

As shown in FIGS. 14 and 15, the slender frame 141 is formed to have a width wide substantially squared U-shaped cross section by bending both side edges of a metal plate, and a guide groove 141*a* extending along the up and down directions is formed therein. The upper frame 142 and the lower frame 143 are formed into the same shape as to each other, and as shown in FIGS. 12, 14 and 15, each of the upper and lower frames 142 and 143 is formed to have a width wide substantially suared U-shaped cross section by bending both ends of a metal plate. Each of the upper frame 142 and the lower frame 143 includes a bottom wall 142*a* or 143*a*, side walls 142*b*, 142*c* or 143*b*, 143*c* disposed at opposite sides of the bottom wall 142*a* or 143*a*, respectively.

Each of the bottom walls 142*a* and 143*a* forms a receiving surface for receiving one end surface of each of the air bags 146 which will be explained in detail latter, and two through holes 142*d* (through holes in the bottom wall 143*a* are not shown) are formed in each of the bottom walls 142*a* and 143*a*.

Four mounting holes 142*e* and 143*e* are formed in each of the side walls 142*b* and 143*b*.

Opposite ends of the slender frame 141 are fixed to intermediate portions of the bottom walls 142*a* and 143*a* of the upper frame 142 and the lower frame 143 in their longitudinal direction (right and left directions in FIGS. 14 and 15) by welding.

The moving frame 144 is composed of a short strip shaped metal plate, and a through hole 144*a* through which the slender frame 141 passes is formed at a center of the moving frame 144. The moving frame 144 can move in the upper and lower directions along the slender frame 141 in a state where the slender frame 141 is inserted through the through hole 144*a*.

The connecting member 145 is integrally mounted to the moving frame 144 by screws (not shown). As shown in FIG. 7, fitting grooves 145*a* which are slidably fitted to opposite side edges 141*b* of the guide groove 141*a* formed in the slender frame 141 are formed in opposite sides of the connecting member 145. The two columnar projections 145*b* for mounting the massage element 130 which will be explained in detail latter are formed on the connecting member 145 at portions closer to a side of the back rest (which will be referred to as "front side" hereinafter) and are separated in the up and down directions.

Figure 17:
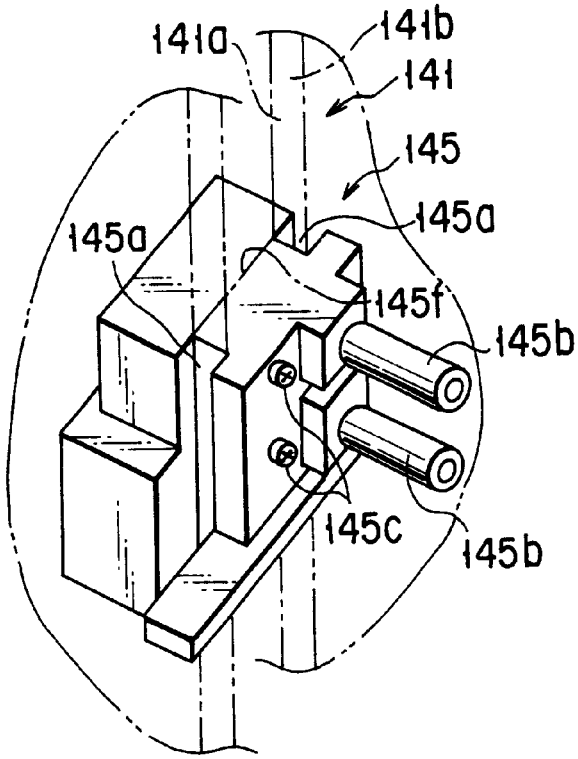
FIG. 17 is a perspective view of a coupling member of the massage element moving mechanism (the massage element positioning device) of the legless chair type massager shown in FIG. 11.

The connecting member 145 is divided in back-and forth directions by divided surfaces (positions of them are shown in FIG. 17 with a one-dot chain line 145*f*) extending in the up and down directions. The connecting member 145 forms the fitting grooves 145*a* by mating front and rear halves to each other and connecting by screws 145*c*. The fitting grooves 145*a* are fitted on the side edges 141*b* of the guide groove 141*a*, thereby mounting the connecting member 145 to the slender frame 141.

The connecting member 145 together with the moving frame 144 moves in the up and down directions along the slender frame 141.

Next, the air bag 146 will be explained in detail.

Figure 16:
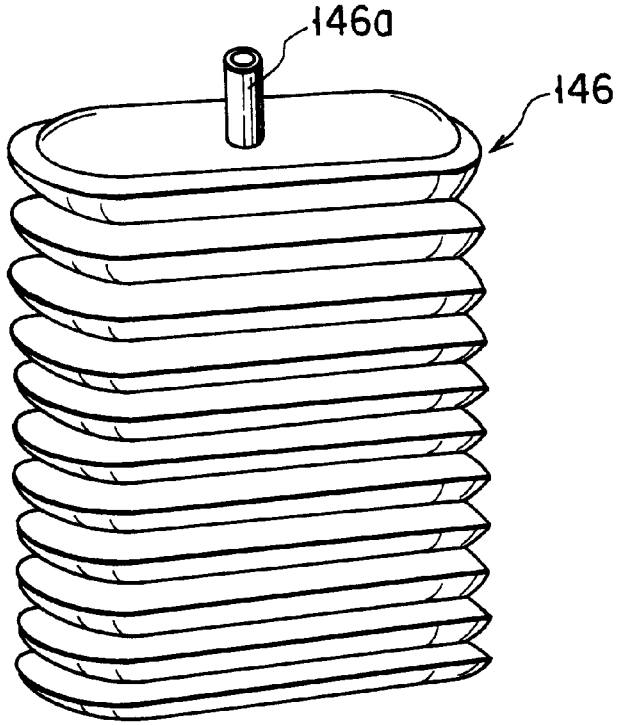
FIG. 16 is a perspective view of an air bag (expandable body) of the massage element moving mechanism (the massage element positioning device) of the legless chair type massager shown in FIG. 11.

As shown in FIG. 16, the air bag 146 is formed into a bellows shape whose projection from above, i.e., in the axial direction in FIG. 16 is a substantially elliptic shape having a minor axis and a major axis. A projecting connection port 146*a* is formed in a center of one end surface (upper surface in FIG. 16) of the air bag 146, and a hose is connected to the connection port 146*a*. Opposite end surfaces of the air bag 146 are formed flatly.

As shown in FIGS. 14 and 15, after the upper frame 142 and the lower frame 143 are fixed to the opposite ends of the slender frame 141 with their longitudinal directions being in parallel with the right and left directions of the back rest 104, and the moving frame 144 together with the connection member 145 is mounted to the slender frame 141, one end surface of each of the two air bags 146, i.e., the end surface on which the connection port 146*a* is provided, is abutted against the bottom wall 142*a* of the upper frame 141, and the other end surface of each thereof is abutted against an upper side surface of the moving frame 144, thereby sandwiching the two air bags 146 between the upper frame 142 and the moving frame 144. When the one end surface of each of the two air bags 146 is abutted against the bottom wall 142*a* of the upper frame 142, the connection ports 146*a* are inserted through the through holes 142*d* provided in the bottom wall 142*a*.

The air bags 146 sandwiched between the upper frame 142 and the moving frame 144 are disposed on the right and left sides of the slender frame 141.

Each of the air bags 146 is disposed such that the major axis direction thereof is in parallel to the right and left directions of the back rest 104, so that the thickness of the back rest 104 can be reduced.

In the same manner as described above, the two air bags 146 are sandwiched between the bottom wall 143*a* of the lower frame 143 and a lower surface of the moving frame 144. At this time, the connection port 146*a* provided in the one end surface of each of the air bags 146 passes through each of the through holes (not shown) provided in the bottom wall 143*a* of the lower frame 143. The pair of air bags 146 are disposed on the right and left sides of the slender frame 141 between the bottom wall 143*a* of the lower frame 143 and the lower surface of the moving frame 144.

Each of the air bags 146 sandwiched between the upper frame 142 and the moving frame 144 functions to push down the moving frame 144 together with the connection member 145. Each of the air bags 146 disposed between the lower frame 143 and the moving frame 144 functions to push up the moving frame 144 together with the connection member 145.

That is, when the compressed air is supplied from the compressed air supplying/discharging device 160 which will be explained in detail latter to the air bags 146 disposed between the upper frame 142 and the moving frame 144, the air bags 146 expand (i.e., extend) in the axial direction, thereby pushing down the moving frame 144 together with the connection member 145. At this time, the air bags 146 disposed between the lower frame 143 and the moving frame 144 are controlled such that they are evacuated and contracted in the axial direction in synchronously with the expansion (i.e., extension) of the air bags 146 disposed between the upper frame 142 and the moving frame 144.

When the compressed air is supplied from the compressed air supplying/discharging device 160 to the air bags 146 disposed between the lower frame 143 and the moving frame 144, the air bags 146 expand (i.e., extend) in the axial direction, thereby pushing up the moving frame 144 together with the connection member 145. At this time, the air bags 146 disposed between the upper frame 142 and the moving frame 144 are controlled such that they are evacuated and contracted in the axial direction in synchronously with the expansion (i.e., extension) of the air bags 146 disposed between the lower frame 143 and the moving frame 144.

In this manner, the air bags 146 disposed between the upper frame 142 and the moving frame 144 function to push down the moving frame 144 together with the connection member 145. Further, the air bags 146 disposed between the lower frame 143 and the moving frame 144 function to push up the moving frame 144 together with the connection member. For this reason, in the following description, the air bags 146 sandwiched between the upper frame 142 and the moving frame 144 are called as pushing down air bags, and the air bags 146 disposed between the lower frame 143 and the moving frame 144 are called as pushing up air bags.

The pushing down air bags 146 function as first air bags, and the pushing up air bags 146 function as second air bags.

The moving mechanism 140 assembled as described above is mounted to the body 102 as shown in FIG. 12, by mounting the side walls 142*b* and 143*b* of the upper frame 142 and the lower frame 143 to the back plate 121 of the back frame 120 by screws 147.

After the moving mechanism 140 is mounted to the back plate 121, one end of each of the hoses 148*a* is connected to the connection port 146*a* of each of the pushing down air bags 146, and one end of each of the hoses 149*a* is connected to the connection port 146*a* of each of the pushing up air bags 146. Both the hoses 148*a* and 148*a* are brought together into one hose 148 and then, the hose 148 is connected to a second air supplying/discharging device 163 of the compressed air supplying/discharging device 160. Similarly, both the hoses 149*a* and 149*a* are brought together into one hose 149 and the hose 149 is connected to a third air supplying/discharging device 164.

Next, the massage element 130 which is to be mounted to, i.e., connected to, the connection member 145 will be explained in detail.

As shown in FIGS. 11 to 13, the massage element 130 includes a base plate 131, a bellows-like massage element air bag 132 mounted to the base plate 131, and pressing members 133 as a pressing portion mounted on the massage element air bag 132.

The base plate 131 is integrally mounted to the columnar projections 145*b* provided on the connection member 145 by screws (not shown). A through hole (not shown) is provided in the base plate 131, and one end of a hose 132*a* passing through the through hole is connected to the massage element air bag 132. The other end of the hose 132*a* is connected to a first air supplying/discharging device 162 of the compressed air supplying/discharging device 160.

The massage element air bag 132 expands or contracts by supplying or discharging the compressed air from or to the compressed air supplying/discharging device 160, and a projection amount of the pressing members 133 from the back rest 104 is varied by the expansion and contraction of the massage element air bag 132. With this structure, the pressing members 133 move from a surface of the back rest 104 toward a back of a user sitting on the chair type massager 101, i.e., move forwards, and press the back.

The forward and backward movements of the pressing members 133 with respect to the surface of the back rest 104 can be so expressed that the pressing members 133 project and retract from the back rest 104.

Next, the compressed air supplying/discharging device 160 will be explained in detail.

Figure 18:
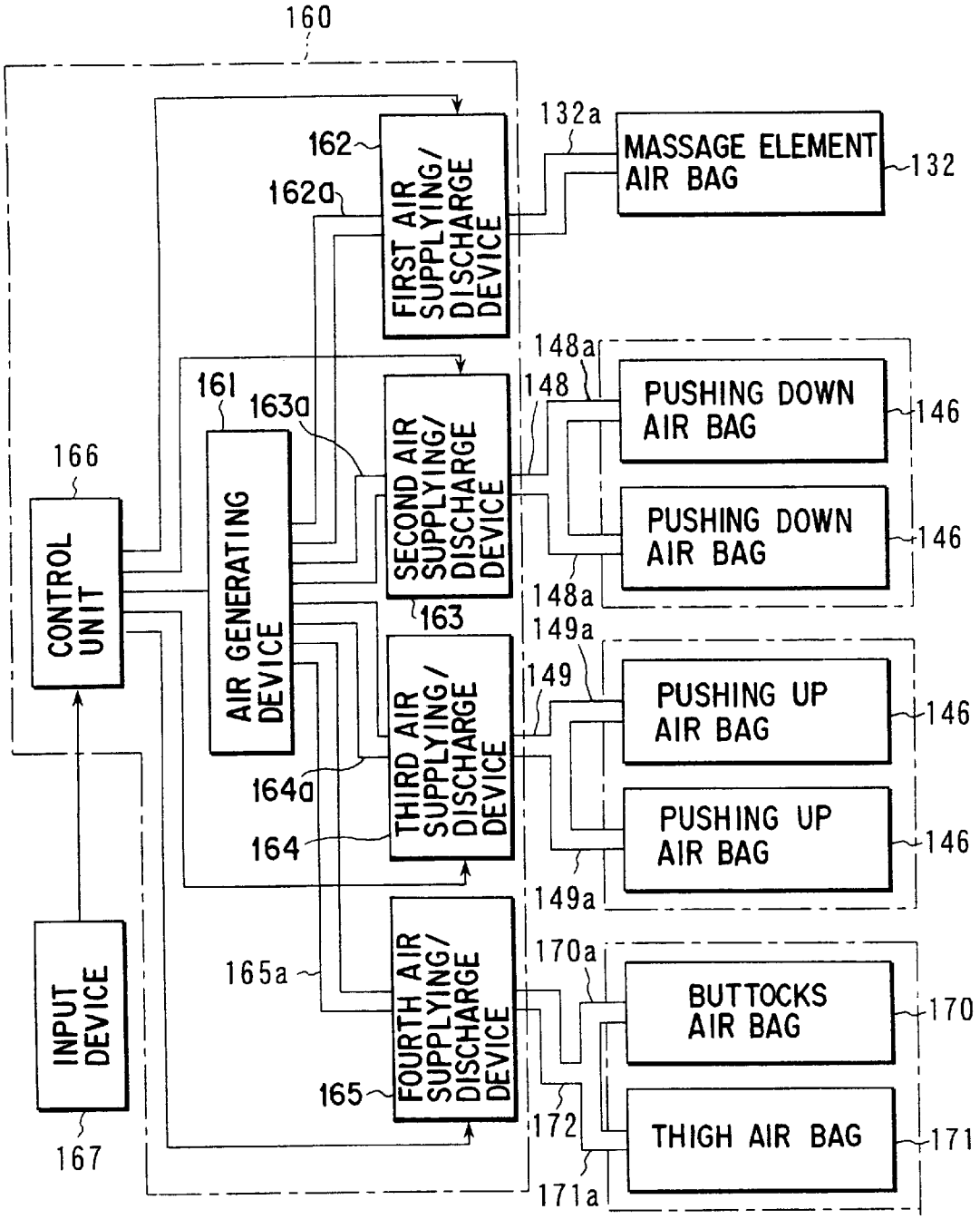
FIG. 18 is a schematic view of a structure for operating the massage element moving mechanism (the massage element positioning device) of the legless chair type massager shown in FIG. 11 and various massage bags (the air bags or the expandable bodies).

As shown in FIG. 18, the compressed air supplying/discharging device 160 includes a compressed air generating device 161 having an air pump, the first to fourth air supplying/discharging devices 162 to 165 having solenoid valves and the like connected to the compressed air generating device 161 through hoses 162*a* to 165*a*, and a control device 66 having a microcomputer for controlling the compressed air supplying/discharging device 160 and the first to fourth air supplying/discharging devices 162 to 165.

As shown in FIG. 12, the compressed air supplying/discharging device 160 is mounted to the back plate 121 by screws 23.

As shown in FIG. 12, a protection plate 125 having a reversed square C-shape cross section is mounted to a rear portion of the back plate 121 by screws (not shown). The protection plate 125 protects the moving mechanism 140, the compressed air supplying/discharging device 160 and the like.

Next, a control circuit of the legless chair type massager 101 will be explained on a basis of FIG. 18 which is a block diagram.

As shown in FIG. 18, the first to fourth air supplying/discharging devices 162 to 165 are connected to the compressed air generating device 161 through the hoses 162*a* to 165*a* as described above. The first air supplying/discharging device 162 is connected to the massage element air bag 132 through the hose 162*a*, the second air supplying/discharging device 163 is connected to the pushing down air bags 146 and 146 through the hoses 148 and 148*a*, the third air supplying/discharging device 164 is connected to the pushing up air bags 146 and 146 through the hoses 149 and 149*a*, the fourth air supplying/discharging device 165 is connected to the buttocks air bag 170 and the thigh air bag 171 through a hose 172 and the hoses 170*a* and 171*a* branched from the hose 172.

The compressed air generating device 161 and the first to fourth air supplying/discharging devices 162 to 165 are controlled in accordance with massage modes set in a control unit 166. An input device 167 including a remote controller is connected to the control unit 166. By operating the input device 167, it is possible to set various massage modes which will be explained later in the control unit 166, and to move the massage element positioning device 140 by the control unit 166.

The various massage modes include a finger-pressure mode for pressing a back which is an effected part of a sitting user by the pressing members 133, a rubbing mode in which the massage element 130 is moved in the up and down directions with the pressing members 133 pressing the back, a combination mode in which the finger-pressure mode and the rubbing mode are combined, and a buttocks/thigh mode.

Next, an operation of the control circuit in each of the various modes will be explained.

When the finger-pressure mode is set, the input device 167 is first operated to move the massage element positioning device 140 in the up and down directions, thereby positioning the pressing members 133 at a desired position of the back of the sitting user. This positioning is carried out by operating up and down moving operation buttons (not shown). At this time, the second air supplying/discharging device 163 and the third air supplying/discharging device 164 are operated, and the compressed air is supplied to or discharged from the pushing up air bags 146 and the pushing down air bags 146. As a result, the pushing up air bags 146 and the pushing down air bags 146 are expanded or contracted, so that the moving frame 144 and the connection member 145 are moved in the up and down directions, and the massage element 130 is moved in the up and down directions such that the massage element is positioned at the desired portion of the back of the sitting user.

As described above, when the compressed air is supplied to one pair of the pushing up air bags 146 and the pushing down air bags 146, the one pair of air bags are expanded, the air is discharged from the other pair of air bags 146 in accordance with the expansion of the one pair of air bags 146, and the other pair of air bags 146 are contracted. That is, the second air supplying/discharging device 163 and the third air supplying/discharging device 164 are controlled such that a compressed air supplying amount per a predetermined unit time of the one pair of air bags 146 to which the compressed air is supplied becomes equal to a compressed air discharging amount per a predetermined unit time of the other pair of air bags 146 from which the compressed air is discharged.

In this manner, the moving frame 44 and the connection member 45 can be moved stably in the up and down directions, and it is possible to reliably hold the massage element 130 at the desired portion after the massage element 130 is positioned at the desired portion of the back of the sitting user.

After the massage element 130 is positioned at the desired portion of the back of the sitting user, the input device 167 is operated to set the finger-pressure mode. When the finger-pressure mode is set, the control unit 166 controls the compressed air generating device 161 and the first air supplying/discharging device 162 to supply and discharge the compressed air to and from the massage element air bag 132, thereby expanding and contracting the massage element air bag 132. By this expansion and contraction, the pressing members 133 are moved forwards and backwards to perform intermittent presses to a desired portion of the back of the sitting user, thereby massaging the desired portion of the back of the sitting user by the pressing members 133.

Next, the rubbing mode will be explained.

When the rubbing mode is to be set, the input device 167 is first operated to control the supplying amount of the compressed air to the massage element air bag 132 so that the projecting amount of the pressing members 133 from the surface of the back rest 104 is adjusted. Next, the input device 167 is operated to set the rubbing mode. When the rubbing mode is set, the control unit 166 confirms the position of the massage element 130. In order to confirm the position of the massage element 130, for example a sensor for detecting the position of the massage element 130 along in up and down directions of the back frame 121 is provided in the back frame 121, and an output of the sensor is sent to the control unit 166.

When the control unit 166 confirms that the massage element 130 is stopped at an upper position, the control unit 166 controls the compressed air generating device 161 and the second air supplying/discharging device 163 such that the compressed air is supplied to the pushing down air bags 146. Simultaneously, the control unit 166 controls the third air supplying/discharging device 164 such that the compressed air is discharged from the pushing up air bags 146. As a result, the moving frame 144 together with the connection member 145 is pushed down by the pushing down air bags 146 which are expanded and extended, and the massage element 130 is also pushed down.

During this time, since the compressed air supplying amount per a unit time of each of the pushing down air bags 146 to which the compressed air is supplied is equal to the compressed air discharging amount per a unit time of each of the pushing up air bags 146 from which the compressed air is discharged, the extending speed of each of the pushing down air bags 146 by expansion becomes equal to the contraction speed of each of the pushing up air bags 146 by contraction. Therefore, the massage element 130 is reliably, gradually and downwardly moved at the above-described extending speed in a stable state.

When the massage element 130 reaches at a predetermined lower position, the control unit 166 controls the compressed air generating device 161 and the third air supplying/discharging device 164 such that the compressed air is supplied to the pushing up air bags 146 in a reversed manner with compared to the above described manner. The control unit 166 controls the second air supplying/discharging device 163 such that the compressed air in the pushing down air bags 146 is discharged. As a result, the massage element 130 is gradually and upwardly moved.

When the massage element 130 moves upwards and reaches a predetermined upper position, the control unit 166 controls the compressed air generating device 161 and the second air supplying/discharging device 163 such that the compressed air is supplied to the pushing down air bags 146. Further, the control unit 166 controls the third air supplying/discharging device 164 such that the compressed air is discharged from the pushing up air bags 146.

The movements of the massage element 130 in the up and down directions are repeated, and during this time, the pressing members 133 move in the up and down directions while pressing, i.e., rubbing, the back of the sitting user.

Next, the combination mode will be explained.

When the combination mode is set by operating the input device 167, the control unit 166 controls the compressed air generating device 161 and the first air supplying/discharging device 162 to keep the supply and discharge of the compressed air to and from the massage element air bag 132 so that the pressing members 133 can move in the back and fourth directions as in the finger-pressure mode. Simultaneously, the control unit 166 continues the supply and discharge of the compressed air to and from the pushing down air bags 146 and the pushing up air bags 146 to continue the movement of the massage element 130 in the up and down directions. With this operation, the massage element 130 moves in the up and down directions while the pressing members 133 move in back and fourth directions so that the back of the sitting user is pressed and rubbed by the pressing members 133. Therefore, the sitting user can obtain the rubbing effect and the finger-pressure effect on his or her back simultaneously.

Next, the buttocks/thigh pressure mode will be explained.

When the buttocks/thigh pressure mode is set by operating the input device 167, the control unit 166 controls the compressed air generating device 161 and the fourth air supplying/discharging device 165 such that the buttocks air bag 170 and the thigh air bag 171 are expanded and contracted. As a result, the buttocks air bag 170 and the thigh air bag 171 press the buttocks and thighs of the sitting user to carry out the air massage.

As described above, since the massage element 130 can move in the up and down directions on the back rest 104 of the chair type massager 101, it is possible to position the massage element 130 at a desired portion of the back of the sitting user, and to perform excellent massage effect on the desired portion of the back of the sitting user.

Since the movement for positioning the massage element 130 is carried out by the combination of the pushing down air bags 146 and the pushing up air bags 146, it is possible to reduce the thickness and weight of the back rest 104 as compared with the conventional structure in which the movement of the massage element is carried out by a gear and a chain wound around the gear.

Further, since each of the pushing down air bags 146 and the pushing up air bags 146 is formed into the substantially elliptic shape in the axial projection, and its major axis is arranged in parallel to the widthwise direction of the back rest 104, the thickness of the back rest 104 can further be made thinner.

In the above-described embodiment, the massage element 130 is composed of the base plate 131, the bellows-like massage element air bag 132 mounted on the base plate 131, and the pressing members 133 mounted to the massage element air bag 132, and the pressing members 133 move in the back and fourth directions on the surface of the back rest 104. However, the pressing members 133 can also be constructed such that they do not move in the back and fourth directions on the surface of the back rest 104. In this case, it is possible to set the rubbing mode.

When the pressing members 133 are constructed such that they do not move in the back and fourth directions on the surface of the back rest 104, the massage element air bag 132 is unnecessary, and the pressing members 133 are directly mounted to the columnar projections 145*b*.

Although the massage element 130 is not covered with the cover 115 in the above embodiment, the massage element 130 can be covered with the cover 115.

Although the moving frame 44 is moved by the independently formed pushing up air bags and pushing down air bags in the above embodiment, it is possible to construct such that the pushing up air bags and the pushing down air bags are integrally formed, and the connection member 45 to which the moving frame 44 is fixed is mounted to an intermediate portion of the integrally formed pushing up and down air bags in the up and down directions. However, when the moving frame 44 is moved by the independently formed pushing up air bags and pushing down air bags as in the above embodiment, it is possible to control the movement of the massage element 130 more precisely. This fact is emphasized by supplying and discharging the compressed air to and from the pushing up air bags and the pushing down air bags synchronously.

The present invention should not be limited to each of the above described embodiments. For example, the positioning device of the present invention can also be used for other than the massager.

Further, the movable massage element used for the massager should not be limited to a movable massage element which carries out the air massage, and it may be a movable massage element which has finger-pressure projections for massaging when a user applies his or her weight on the projections, or may be a vibration massaging type movable massage element in which a vibrator is embedded, or may be a moxa-treatment type movable massage element which includes therein an electric heat source for applying a thermal stimulus onto an affected part of the body of the user.

In addition to the chair type massager, the present invention can also be applied to a mat type air massager and the like. Further, the present invention can be applied, not only to the air massager, but also to a so-called mechanical type massager for massaging by pressing and retracting rollers as massage elements using a mechanical structure onto and from the affected parts of the body of the user.

As apparent from the above description, the positioning device of the present invention can be used in various technical fields, but can be preferably used for a massager including a massager body and a movable massage element provided in the massager body for reciprocating motion, to adjust a reference position of the movable massage element with respect to the massager body more preferably, the positioning device is used in an air massager which has a movable massage element and which carries out air massage utilizing compressed air, to adjust a reference position of the movable massage element with respect to the massager body.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A massager comprising:

a chair body including a seat and a back rest;

a guide member provided on the back rest;

a movable member movably guided in up and down directions by the guide member;

an upper expandable body disposed on an upper side of the movable member and a lower expandable body disposed on a lower side of the movable member, wherein an upper end of the upper expandable body is supported at a position corresponding to an upper end portion of the guide member and a lower end of the lower expandable body is supported at a position corresponding to a lower end portion of the guide member, and wherein the upper and lower expandable bodies are expanded and contracted by air pressure to thereby move the movable member in the up and down directions;

an air supplying device;

an air path device for bringing the air supplying device and the expandable bodies into communication with each other, and for supplying air from the air supplying device to the expandable bodies;

a valve device, provided in the air path device, for opening and closing the air path device and for controlling expansion and contraction of the expandable bodies so that the expandable bodies can be held in arbitrary expanded states by a valve closing action; and a massage element provided on the movable member and projecting from a surface of the back rest to abut against a body of person a sitting on the chair body.

2. A massager according to claim 1, wherein:

the massage element is adapted to reciprocate in a direction crossing the surface of the back rest.

3. A massager according to claim 1, wherein:

the chair body is provided with a plurality of massage bags;

the plurality of massage bags are in communication with the air supplying device via the air path device; and the air path device and the valve device are structured such that the air path device and the valve device repeat supply of air from the air supplying device to the plurality of massage bags and discharge of air from the plurality of massage bags.

4. A massager according to claim 1, wherein:

an upper end of the lower expandable body is connected to the movable member; and a lower end of the upper expandable body is adapted to contact and separate from the movable member.

5. A massager according to claim 1, wherein:

the air path device and the valve device are formed into a closed loop which returns air in one of the upper and lower expandable bodies to the air supplying device while the other one of the upper and lower expandable bodies is expanded by air supplied from the air supplying device.

6. A massager according to claim 1, wherein:

each of the expandable bodies is formed in a bellows shape and has a substantially flattened elliptic cross section in a direction perpendicular to expanding and contracting directions of the expandable bodies; and a periphery of the substantially flattened elliptic cross section of each of the expandable bodies comprises two long sides and two short sides, with the short sides connecting respective ends of the long sides to each other, and the long sides being arranged in a direction crossing the surface of the back rest and extending along the surface of the back rest.

7. A massager according to claim 1, further comprising:

an upper reinforcing frame provided at the upper end portion of the guide member and a lower reinforcing frame provided at the lower end portion of the guide member;

wherein the upper end of the upper expandable body is fixed to a lower surface of the upper reinforcing frame and the lower end of the lower expandable body is fixed to an upper surface of the lower reinforcing frame.

8. A massager according to claim 6, further comprising:

an upper reinforcing frame provided at the upper end portion of the guide member and a lower reinforcing frame provided at the lower end portion of the guide member;

wherein the upper end of the upper expandable body is fixed to a lower surface of the upper reinforcing frame and the lower end of the lower expandable body is fixed to an upper surface of the lower reinforcing frame.

9. A massager according to claim 8, further comprising:

at least one supporting member extending in the expanding and contracting directions of the expandable bodies between the upper and lower reinforcing frames;

wherein the expandable bodies are arranged such that the at least one supporting member extends along one of the long sides of the peripheries of the substantially flattened elliptic cross sections of the expandable bodies.

* * * * *